US010738956B2

(12) United States Patent
Shibata

(10) Patent No.: US 10,738,956 B2
(45) Date of Patent: Aug. 11, 2020

(54) LIGHTING DEVICE

(71) Applicant: KOITO MANUFACTURING CO., LTD., Tokyo (JP)

(72) Inventor: Hiroki Shibata, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 5 days.

(21) Appl. No.: 16/096,998

(22) PCT Filed: Apr. 18, 2017

(86) PCT No.: PCT/JP2017/015596
§ 371 (c)(1),
(2) Date: Oct. 26, 2018

(87) PCT Pub. No.: WO2017/188066
PCT Pub. Date: Nov. 2, 2017

(65) Prior Publication Data

US 2019/0137065 A1 May 9, 2019

(30) Foreign Application Priority Data

Apr. 27, 2016 (JP) ..... 2016-089552
Apr. 27, 2016 (JP) ..... 2016-089553
Apr. 27, 2016 (JP) ..... 2019-089554

(51) Int. Cl.

| | |
|---|---|
| ***F21Y 107/50*** | (2016.01) |
| ***F21S 41/19*** | (2018.01) |
| ***F21S 43/00*** | (2018.01) |
| ***F21S 41/33*** | (2018.01) |
| ***F21S 45/47*** | (2018.01) |

(52) U.S. Cl.
CPC ..... *F21S 41/192* (2018.01); *F21S 41/33* (2018.01); *F21S 43/00* (2018.01); *F21S 45/47* (2018.01); *F21Y 2107/50* (2016.08)

(58) Field of Classification Search
CPC ..... F21S 31/192; F21S 31/33; F21S 45/47; F21S 43/00; F21S 43/30; F21S 43/50;
(Continued)

(56) References Cited

U.S. PATENT DOCUMENTS 5,094,628 A * 3/1992 Kano ..... H01R 13/7175 362/800
2003/0227774 A1* 12/2003 Martin ..... F21V 7/09 362/240
(Continued)

FOREIGN PATENT DOCUMENTS

JP 2004-111355 A 4/2004
JP 2013-229331 A 11/2013
(Continued)

OTHER PUBLICATIONS

International Search Report issued in Application No. PCT/JP2017/015596, dated Jun. 6, 2017 (5 pages).
(Continued)

*Primary Examiner* — Evan P Dzierzynski
(74) *Attorney, Agent, or Firm* — Osha Liang LLP

(57) ABSTRACT

A lighting device mounted on a vehicle includes a first light source, a second light source, a heat dissipation member having a wall defining a hollow portion and configured to dissipate heat generated by operations of the first light source and the second light source, and a single reflector member mounted on the heat dissipation member. The first light source and the second light source are disposed at positions facing the hollow portion with the wall interposed therebetween, respectively. The first light source and the second light source are configured to emit light in directions intersecting with a front and rear direction, respectively. The reflector member has a first reflecting surface configured to reflect light emitted from the first light source in a predetermined direction, and a second reflecting surface config-
(Continued)

ured to reflect light emitted from the second light source in a predetermined direction.

9 Claims, 21 Drawing Sheets

(58) Field of Classification Search
CPC ..... F21S 43/37; F21S 43/19; F21S 43/195; F21S 43/14; F21S 43/31; F21Y 2107/50
See application file for complete search history.

(56) References Cited

U.S. PATENT DOCUMENTS

2008/0291634 A1* 11/2008 Weiser ..... C09K 5/14 361/708
2014/0347875 A1* 11/2014 Huang ..... F21S 45/48 362/516
2017/0284647 A1* 10/2017 Morin ..... F21K 9/232
2018/0106434 A1* 4/2018 Gao ..... F21K 9/237
2018/0156440 A1* 6/2018 Eggink ..... F21K 9/232

FOREIGN PATENT DOCUMENTS

JP 2014-146509 A 8/2014
JP 2015-137031 A 7/2015

OTHER PUBLICATIONS

Written Opinion issued in International Application No. PCT/JP2017/015596, dated Jun. 6, 2017 (10 pages).
International Preliminary Report on Patentability issued in Application No. PCT/JP2017/015596, dated Nov. 3, 2018, (6 pages).

* cited by examiner

LIGHTING DEVICE

CROSS-REFERENCE TO RELATED APPLICATIONS

The present application is a national stage application of PCT/JP2017/015596, and claims priority to Japanese Patent Application No. 2016-089552 filed on Apr. 27, 2016, Japanese Patent Application No. 2016-089553 filed on Apr. 27, 2016, and Japanese Patent Application No. 2016-089554 filed on Apr. 27, 2016, the contents of which are incorporated herein by reference in their entirety.

BACKGROUND

Technical Field

The disclosure relates to a lighting device mounted on a vehicle.

Related Art

Patent Document 1 discloses a headlamp for a motorcycle, which is an example of this type of lighting device. The headlamp includes a plurality of light sources and a heat dissipation member. The heat dissipation member dissipates heat generated from the respective light sources. The plurality of light sources and the heat dissipation member are accommodated in a lamp chamber defined by a housing and a translucent cover. The translucent cover has a portion having a lens function. The light emitted from the respective light sources travels in a predetermined direction by passing through the portion having the lens function and illuminates the front of the headlamp with a predetermined light distribution pattern.

CITATION LIST

Patent Document

Patent Document 1: Japanese Patent Laid-Open Publication No. 2015-137031

SUMMARY

There is a demand for suppressing an increase in the size of a lighting device including a plurality of light sources and a heat dissipation member.

A first aspect for meeting the above-described demand provides a lighting device mounted on a vehicle, the lighting device including:

a first light source;

a second light source;

a heat dissipation member having a wall defining a hollow portion and configured to dissipate heat generated by the operations of the first light source and the second light source; and a single reflector member mounted on the heat dissipation member, in which the first light source and the second light source are disposed at positions facing the hollow portion with the wall interposed therebetween, respectively, in which the first light source and the second light source are configured to emit light in directions intersecting with a front and rear direction, respectively, and in which the reflector member has a first reflecting surface configured to reflect light emitted from the first light source in a predetermined direction, and a second reflecting surface configured to reflect light emitted from the second light source in a predetermined direction.

According to the above configuration, the light emitted from the first light source is reflected by the first reflecting surface of the reflector member, and the light emitted from the second light source is reflected by the second reflecting surface of the reflector member. Since the space spreading in a direction intersecting with the front and rear direction of the lighting device having a relatively high degree of freedom of layout can be effectively utilized, it is easy to suppress an increase in the size in the front and rear direction of the lighting device, as compared to the configuration as disclosed in Patent Document in which the distribution of the light emitted forward from the light source is controlled by a lens part formed in the translucent cover.

Further, since the first light source and the second light source are disposed at positions facing the hollow portion of the heat dissipation member having a large surface area, the heat generated by the operations of the first light source and the second light source can be effectively dissipated. Therefore, the volume of the heat dissipation member necessary for obtaining desired heat dissipation performance can be reduced, and an increase in the size of the lighting device can be suppressed.

Furthermore, since the first reflecting surface and the second reflecting surface are parts of a single reflector member, the number of steps for mounting to the heat dissipation member can be minimized.

The lighting device can be configured as follows.

The lighting device includes a first conducting wire electrically connected to the first light source; and a second conducting wire electrically connected to the second light source.

in which the first conducting wire and the second conducting wire are disposed behind the reflector member.

According to this configuration, the reflector member mounted to the heat dissipation member can have a function of covering and concealing the first conducting wire and the second conducting wire. In this way, the number of parts is reduced, and an increase in the size of the lighting device including a plurality of light sources and the heat dissipation member can be suppressed.

Alternatively, the lighting device can be configured as follows.

The lighting device includes a first conducting wire electrically connected to the first light source; and a second conducting wire electrically connected to the second light source, in which the first conducting wire and the second conducting wire extend in the hollow portion.

That is, the hollow portion formed for improving the heat dissipation property is utilized as a space for arranging the first conducting wire and the second conducting wire. In this way, the utilization efficiency of the space is improved, and an increase in the size of the lighting device including a plurality of light sources and the heat dissipation member can be suppressed.

In this case, the lighting device can be configured as follows.

The lighting device includes a translucent cover through which light emitted from the first light source and the second light source is transmitted, in which the translucent cover is mounted to the reflector member.

According to such a configuration, the reflector member can function as a housing defining the lamp chamber. A mechanism for adjusting the posture of the reflector member may be provided outside the reflector member, as necessary. Therefore, it is possible to further suppress an increase in the size of the lighting device including a plurality of light sources and the heat dissipation member.

The lighting device can be configured as follows.

The lighting device includes a third light source disposed at a position facing the hollow portion with the wall interposed therebetween, in which the third light source is configured to emit light in a direction intersecting with the front and rear direction.

According to such a configuration, three or more light sources can be arranged with high space utilization efficiency. In this way, an increase in the size of the lighting device including a plurality of light sources and the heat dissipation member can be suppressed.

The lighting device can be configured as follows.

The first light source is configured to emit light for illuminating a first area, and the second light source is configured to emit light for illuminating a second area different from the first area.

According to such a configuration, a plurality of light sources for illuminating different areas can be arranged with high space utilization efficiency, and an increase in the size of the lighting device including a plurality of light sources and the heat dissipation member can be suppressed.

A second aspect for meeting the above-described demand provides a lighting device mounted on a vehicle, the lighting device including:

a first light source;

a first reflecting surface configured to reflect light emitted from the first light source in a predetermined direction;

a first conducting wire electrically connected to the first light source in front of the first reflecting surface;

a second light source;

a second reflecting surface configured to reflect light emitted from the second light source in a predetermined direction;

a second conducting wire electrically connected to the second light source in front of the second reflecting surface; and an opaque cover covering the first conducting wire and the second conducting wire at least from the front.

When taking care not to hinder the progress of the reflected light, there is a relatively large space margin in front of the first reflecting surface and the second reflecting surface. By positively utilizing such a space and making electrical connection with the light source, it is possible to suppress an increase in the size of the lighting device including a plurality of light sources, particularly in the front and rear direction, as compared to the configuration in which electrical connection with the light source is made behind the reflecting surfaces.

On the other hand, the first conducting wire and the second conducting wire are covered by the opaque cover at least from the front. Therefore, even when an electrical connection portion with the light source is arranged in front of the first reflecting surface and the second reflecting surface, it is possible to prevent the electrical connection portion from being visually recognized from the front. As a result, it is possible to suppress an increase in the size of the lighting device including a plurality of light sources while avoiding a decrease in the product value.

The lighting device can be configured as follows.

The lighting device includes a first connector electrically connected to the first light source; and a second connector electrically connected to the second light source, in which the first conducting wire is connected to the first connector from the front, in which the second conducting wire is connected to the second connector from the front, and in which the opaque cover covers the first connector and the second connector at least from the front.

According to such a configuration, it is possible to improve the efficiency of the connection work of the first conducting wire and the second conducting wire performed in assembling the lighting device. On the other hand, the first connector and the second connector are covered by the opaque cover at least from the front. Therefore, even when the first connector and the second connector are arranged in front of the first reflecting surface and the second reflecting surface, it is possible to prevent the first connector and the second connector from being visually recognized from the front. As a result, it is possible to improve the assembling workability of the lighting device including a plurality of light sources while avoiding a decrease in the product value.

The lighting device can be configured as follows.

The first reflecting surface, the second reflecting surface, and the opaque cover are parts of a single reflector member.

According to such a configuration, the reflector member can have a function of covering and concealing the electrical connection portion with the light source. In this way, the number of parts is reduced, and an increase in the size of the lighting device including a plurality of light sources can be suppressed.

DETAILED DESCRIPTION

Hereinafter, examples of embodiments will be described in detail with reference to the accompanying drawings. In each of the drawings used in the following description, the scale of each member is suitably changed in order to have a recognizable size. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

In the accompanying drawings, the arrow F indicates the front direction of the structure shown. The arrow B indicates the rear direction of the structure shown. The arrow U indicates the upper direction of the structure shown. The arrow D indicates the lower direction of the structure shown. The arrow R indicates the right direction of the structure shown. The arrow L indicates the left direction of the structure shown. The "right" and "left" used in the following description indicate the left and right directions as viewed from a driver's seat.

Figure 1:
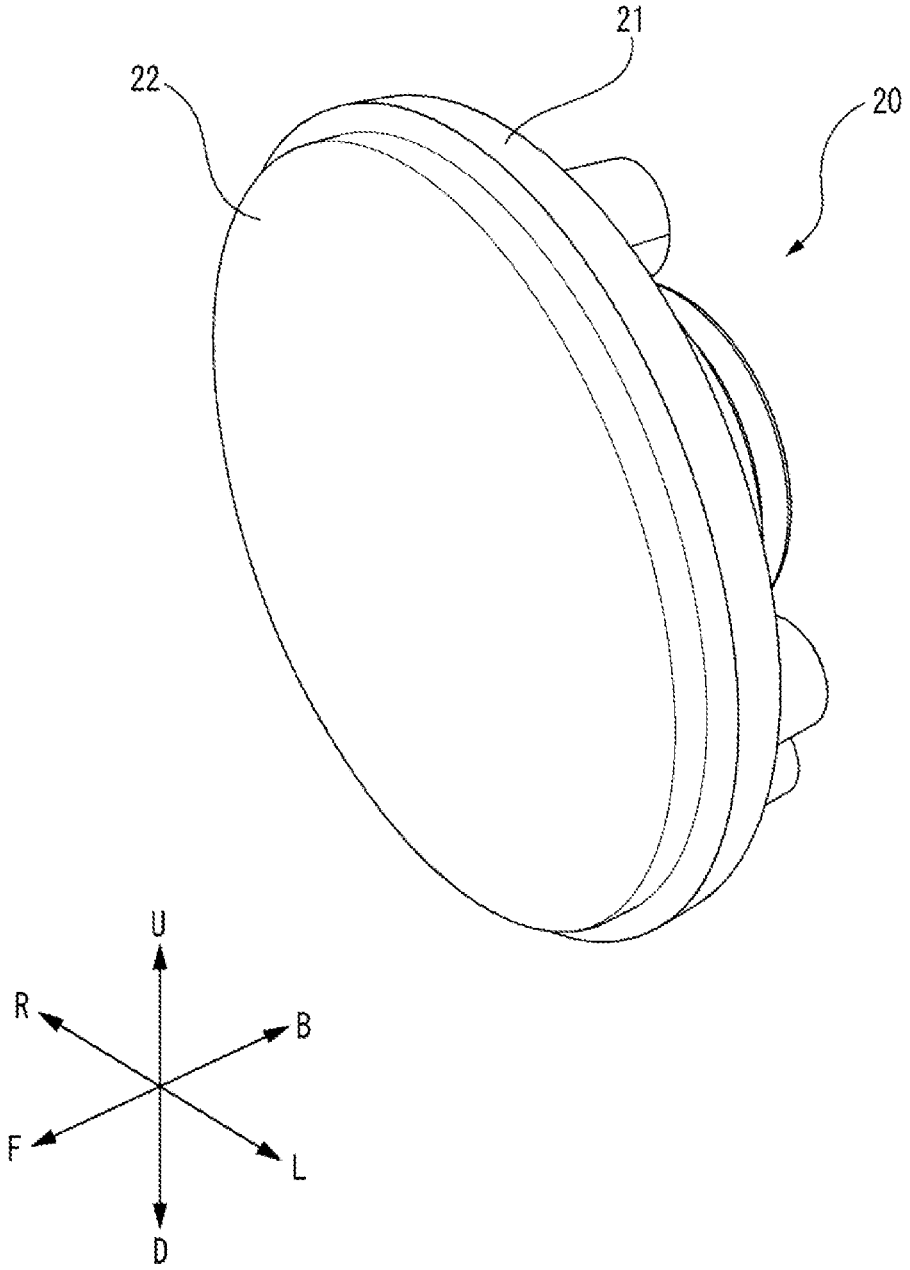
FIG. 1 is a perspective view showing a headlamp according to a first embodiment.

FIG. 1 shows an appearance of a headlamp 20 (an example of the lighting device) according to a first embodiment as viewed from the front left upper. The headlamp 20 is mounted on a front portion of a vehicle. The headlamp 20 includes a housing 21 and a translucent cover 22.

Figure 2:
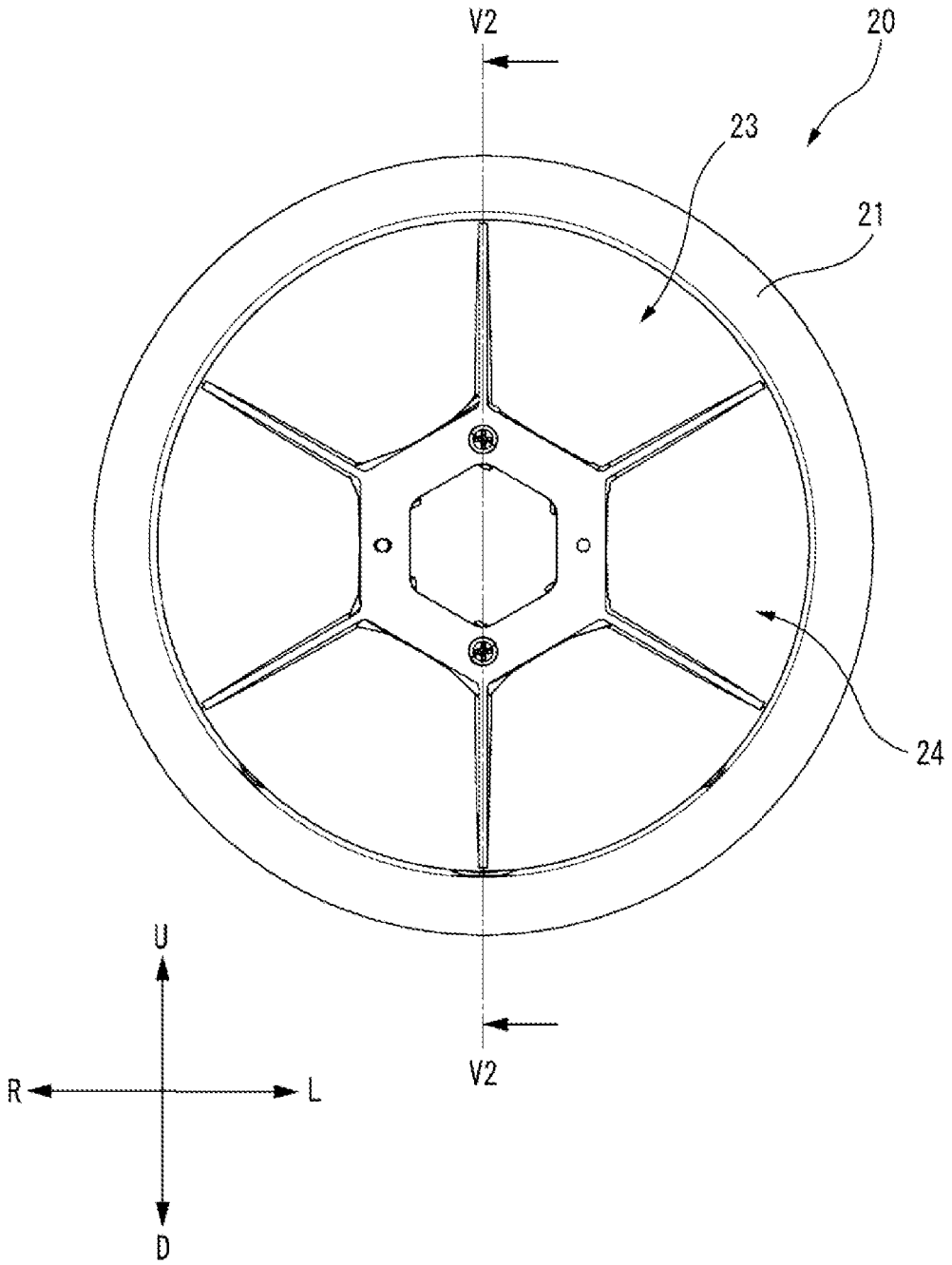
FIG. 2 is a front view showing a part of the headlamp in FIG. 1.

FIG. 2 is a front view showing an appearance of the headlamp 20 from which the translucent cover 22 is removed from the state shown in FIG. 1. The translucent cover 22 is mounted to the housing 21 and defines a lamp chamber 23. The headlamp 20 includes a reflector member 24. The reflector member 24 is accommodated in the lamp chamber 23.

Figure 3:
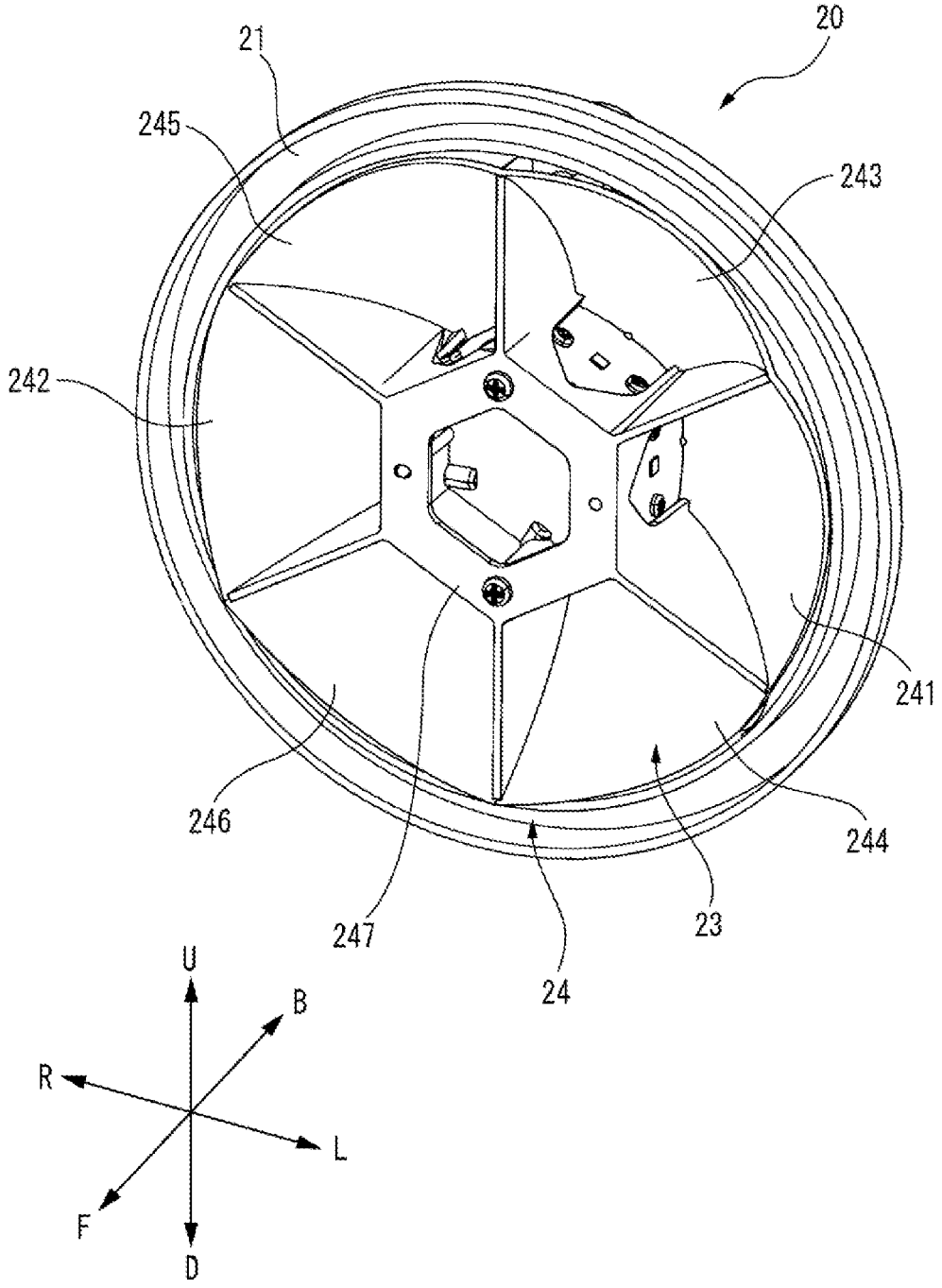
FIG. 3 is a perspective view showing a part of the headlamp in FIG. 1.
Figure 4:
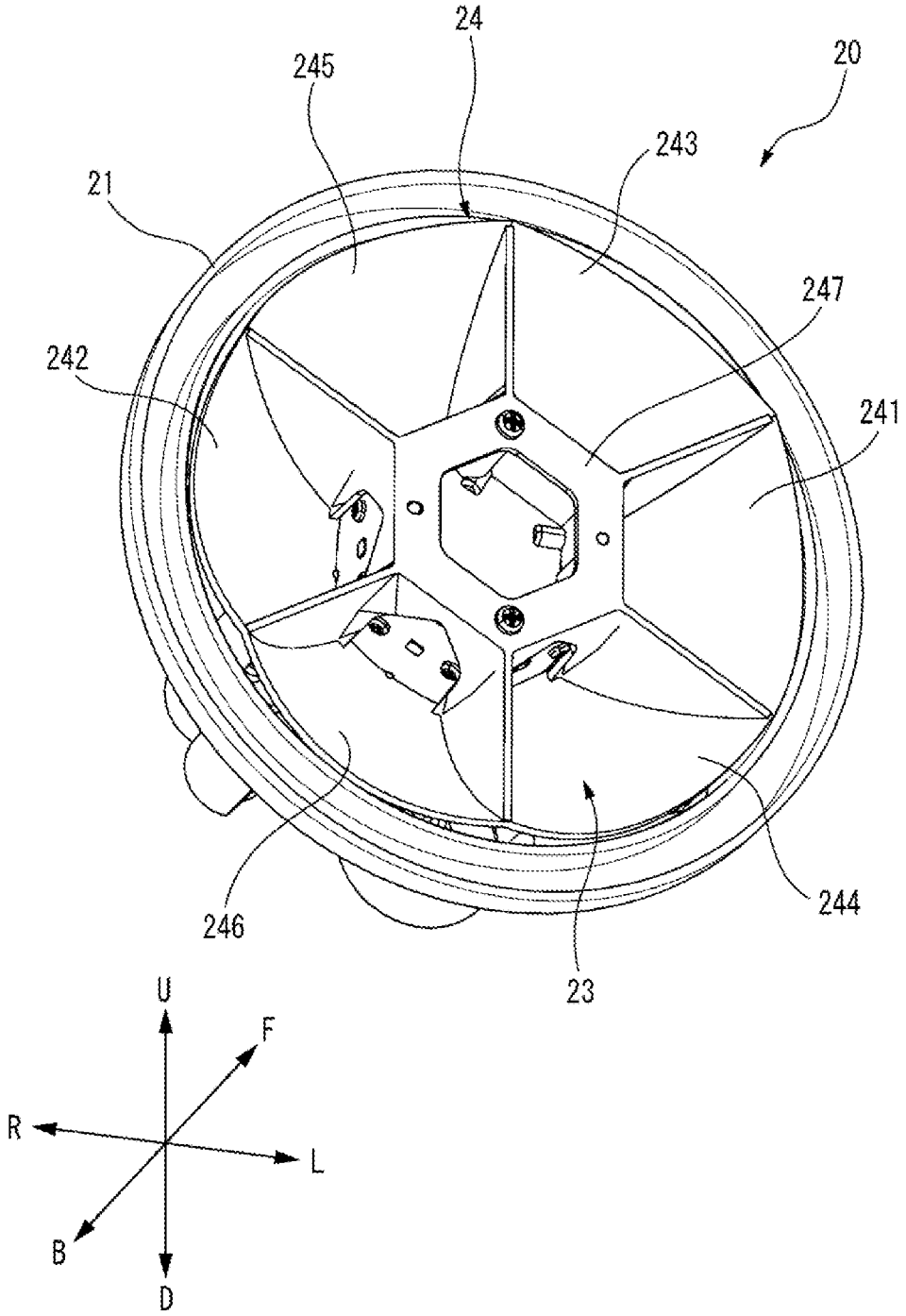
FIG. 4 is a perspective view showing a part of the headlamp in FIG. 1.

FIG. 3 shows an appearance of the headlamp 20 in the state shown in FIG. 2, as viewed from the front left upper. FIG. 4 shows an appearance of the headlamp 20 in the state shown in FIG. 2, as viewed from the front right lower.

The reflector member 24 is an integrally molded product made of resin or the like. The reflector member 24 has a left reflecting surface 241 (an example of the first reflecting surface), a right reflecting surface 242 (an example of the second reflecting surface), an upper left reflecting surface 243, a lower left reflecting surface 244, an upper right reflecting surface 245, a lower right reflecting surface 246, and an opaque cover portion 247.

Figure 5:
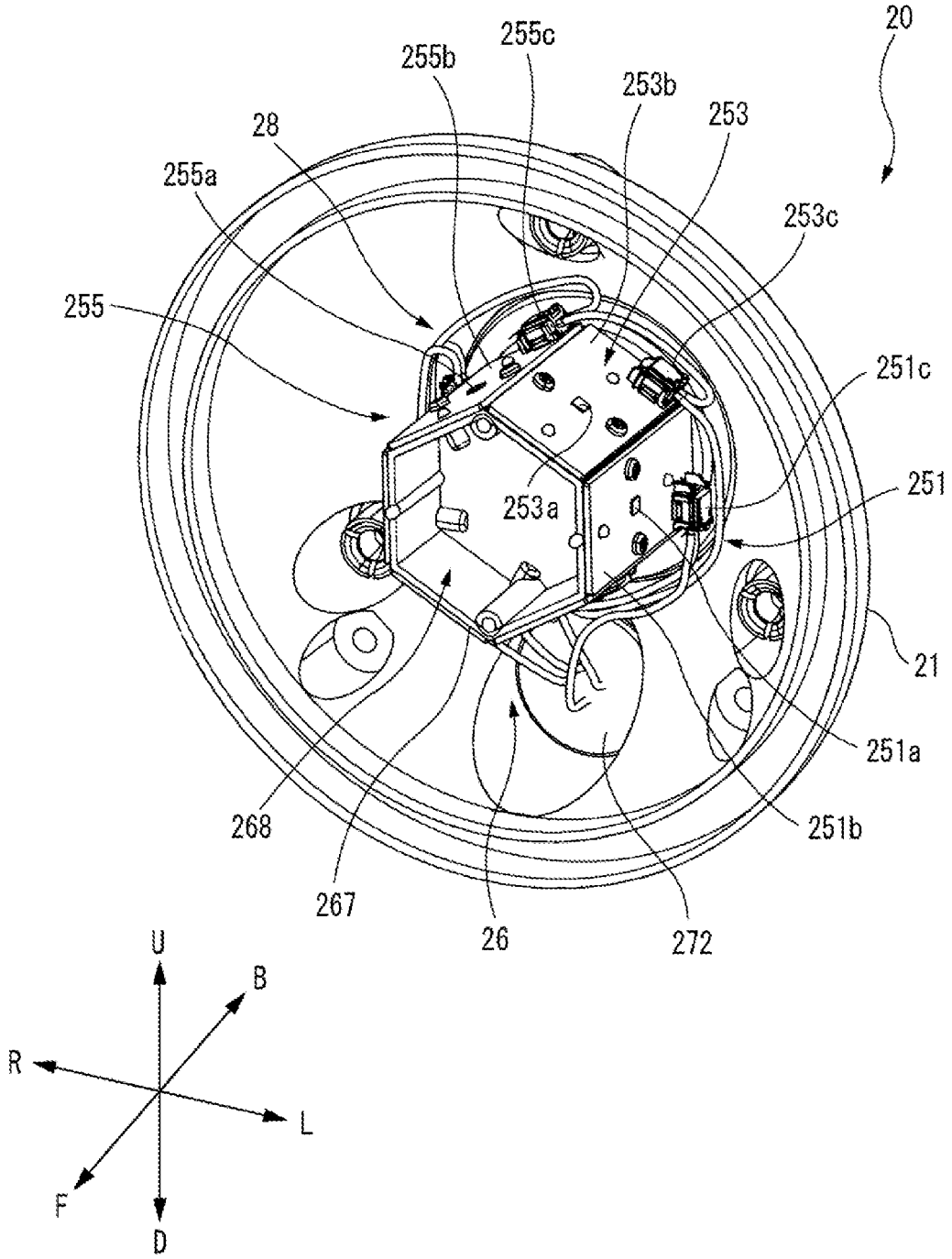
FIG. 5 is a perspective view showing a part of the headlamp in FIG. 1.
Figure 6:
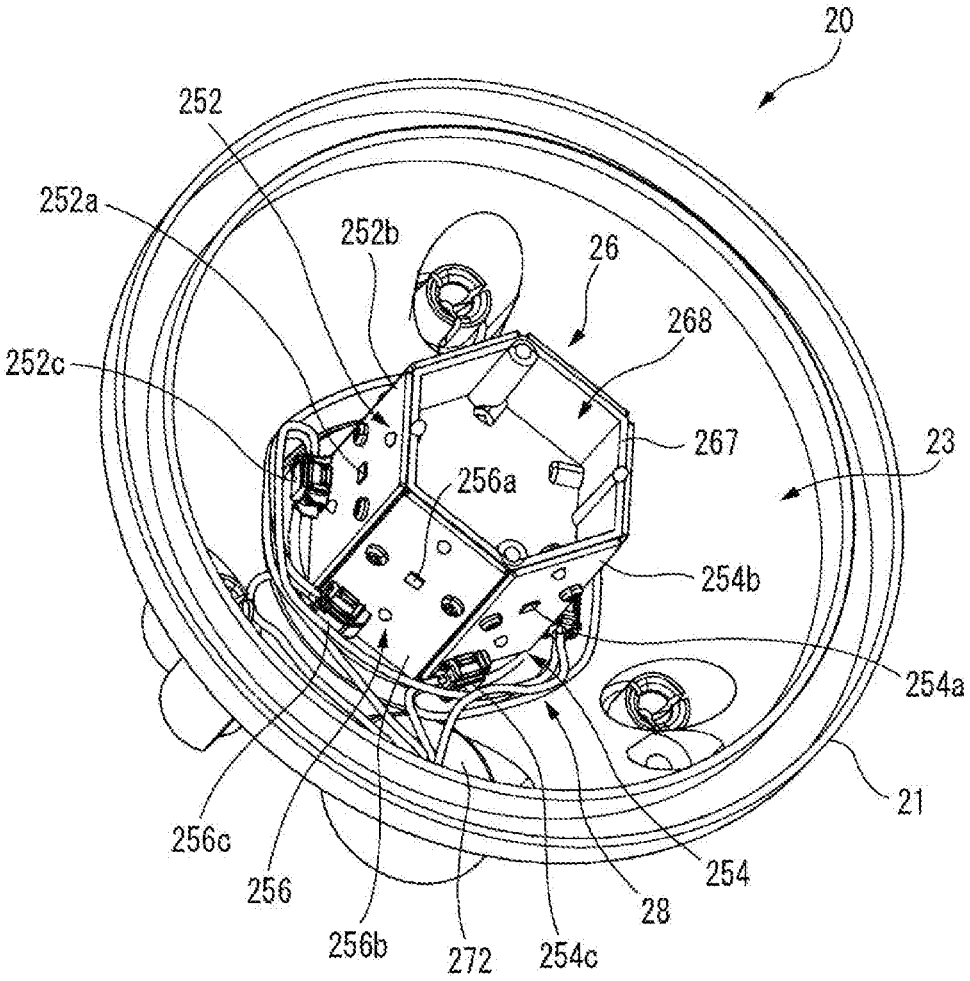
FIG. 6 is a perspective view showing a part of the headlamp in FIG. 1.
Figure 6:
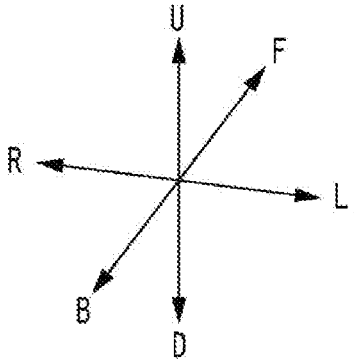

FIG. 5 shows an appearance of the headlamp 20 from which the reflector member 24 is removed from the state shown in FIG. 3, as viewed from the front left upper. FIG. 6 shows an appearance of the headlamp 20 from which the reflector member 24 is removed from the state shown in FIG. 4, as viewed from the front right lower.

The headlamp 20 includes a left light source unit 251, a right light source unit 252, an upper left light source unit 253, a lower left light source unit 254, an upper right light source unit 255, and a lower right light source unit 256.

The left light source unit 251 includes a left light source 251*a* (an example of the first light source), a left circuit board 251*b*, and a left connector 251*c*. The left circuit board 251*b* supports the left light source 251*a* and the left connector 251*c*. The left circuit board 251*b* has a circuit for electrically connecting the left light source 251*a* and the left connector 251*c*.

The right light source unit 252 includes a right light source 252*a* (an example of the second light source), a right circuit board 252*b*, and a right connector 252*c*. The right circuit board 252*b* supports the right light source 252*a* and the right connector 252*c*. The right circuit board 252*b* has a circuit for electrically connecting the right light source 252*a* and the right connector 252*c*.

The upper left light source unit 253 includes an upper left light source 253*a*, an upper left circuit board 253*b*, and an upper left connector 253*c*. The upper left circuit board 253*b* supports the upper left light source 253*a* and the upper left connector 253*c*. The upper left circuit board 253*b* has a circuit for electrically connecting the upper left light source 253*a* and the upper left connector 253*c*.

The lower left light source unit 254 includes a lower left light source 254*a*, a lower left circuit board 254*b*, and a lower left connector 254*c*. The lower left circuit board 254*b* supports the lower left light source 254*a* and the lower left connector 254*c*. The lower left circuit board 254*b* has a circuit for electrically connecting the lower left light source 254*a* and the lower left connector 254*c*.

The upper right light source unit 255 includes an upper right light source 255*a*, an upper right circuit board 255*b*, and an upper right connector 255*c*. The upper right circuit board 255*b* supports the upper right light source 255*a* and the upper right connector 255*c*. The upper right circuit board 255*b* has a circuit for electrically connecting the upper right light source 255*a* and the upper right connector 255*c*.

The lower right light source unit 256 includes a lower right light source 256*a*, a lower right circuit board 256*b*, and a lower right connector 256*c*. The lower right circuit board 256*b* supports the lower right light source 256*a* and the lower right connector 256*c*. The lower right circuit board 256*b* has a circuit for electrically connecting the lower right light source 256*a* and the lower right connector 256*c*.

The left light source 251*a*, the right light source 252*a*, the upper left light source 253*a*, the lower left light source 254*a*, the upper right light source 255*a*, and the lower right light source 256*a* are semiconductor light emitting elements for emitting light having a predetermined wavelength. Examples of the semiconductor light emitting element can include a light emitting diode (LED), a laser diode (LD), an organic EL element, or the like.

Figure 7:
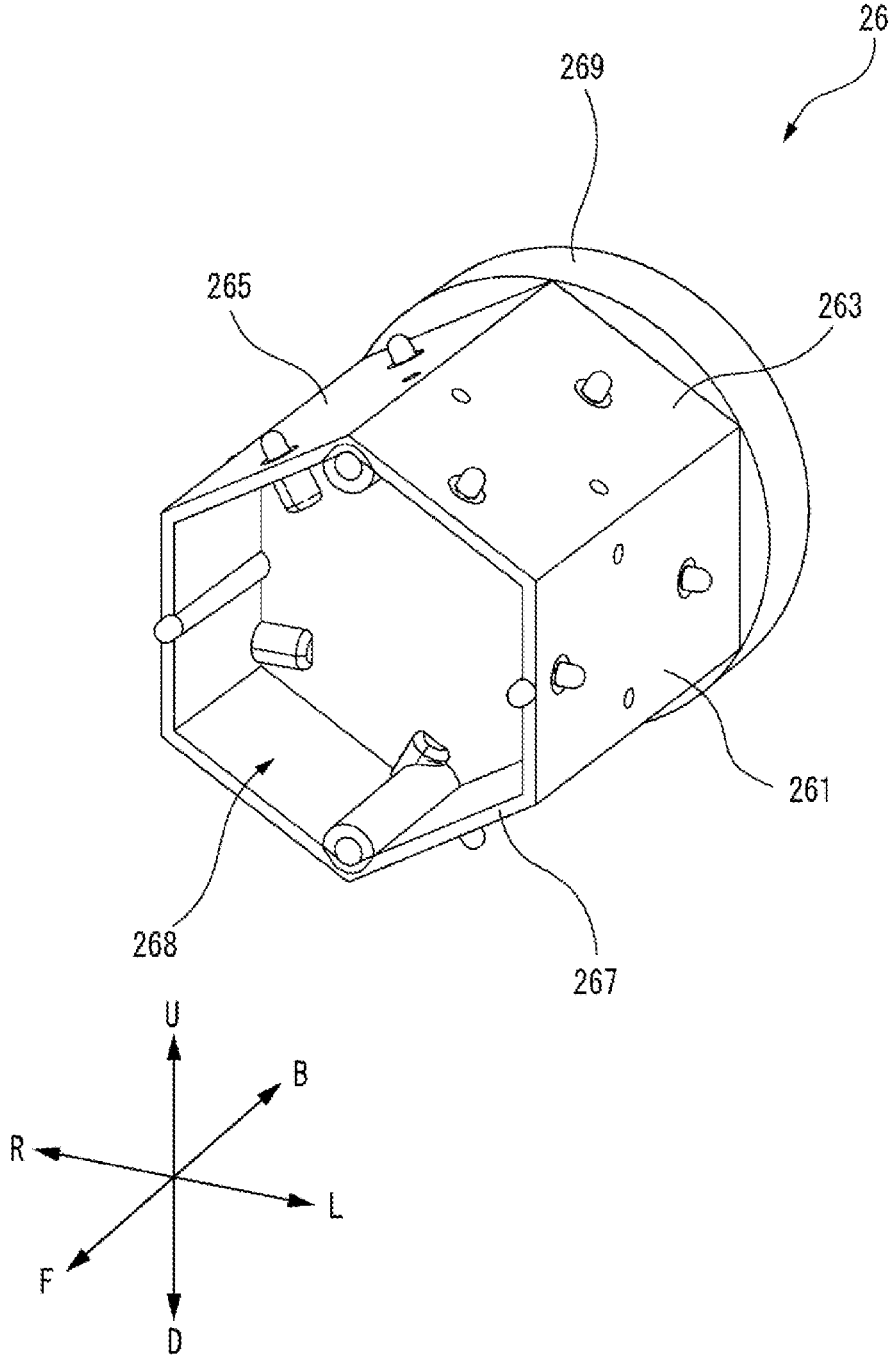
FIG. 7 is a perspective view showing a heat dissipation member in the headlamp in FIG. 1.
Figure 8:
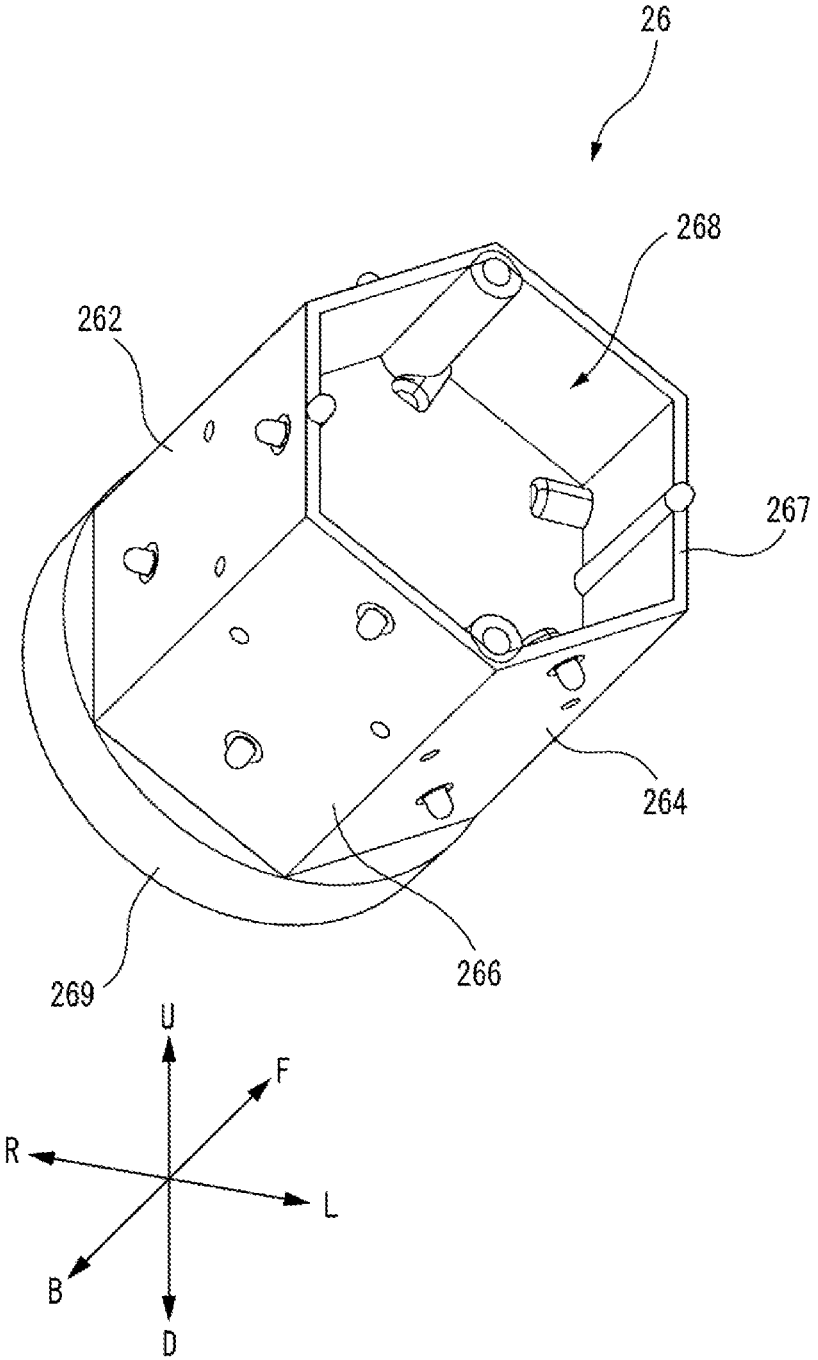
FIG. 8 is a perspective view showing the heat dissipation member in the headlamp in FIG. 1.

The headlamp 20 includes a heat dissipation member 26. The heat dissipation member 26 is formed of a material having a relatively high thermal conductivity, such as metal. FIG. 7 shows an appearance of the heat dissipation member 26 as viewed from the front left upper. FIG. 8 shows an appearance of the heat dissipation member 26 as viewed from the front right lower.

The heat dissipation member 26 has a left support surface 261, a right support surface 262, an upper left support surface 263, a lower left support surface 264, an upper right support surface 265, and a lower right support surface 266.

The left support surface 261 is a flat surface facing the left. The upper left support surface 263 is a flat surface facing the left upper. The upper left support surface 263 is positioned on the right side and on the upper side of the left support surface 261. The lower left support surface 264 is a flat surface facing the left lower. The lower left support surface 264 is positioned on the right side and on the lower side of the left support surface 261.

The right support surface 262 is a flat surface facing the right. The upper right support surface 265 is a flat surface facing the right upper. The upper right support surface 265 is positioned on the left side and on the upper side of the right support surface 262. The lower right support surface 266 is a flat surface facing the right lower. The lower right support surface 266 is positioned on the left side and on the lower side of the right support surface 262.

The heat dissipation member 26 has a wall portion 267. The wall portion 267 defines a bottomed hollow portion 268. The hollow portion 268 is opened to the front. The left support surface 261, the right support surface 262, the upper left support surface 263, the upper right support surface 265, the lower left support surface 264, and the lower right support surface 266 are parts of the wall portion 267.

As is apparent from FIGS. 5 and 7, the left support surface 261 supports the left circuit board 251*b*. The upper left support surface 263 supports the upper left circuit board 253*b*. The upper right support surface 265 supports the upper right circuit board 255*b*.

As is apparent from FIGS. 6 and 8, the right support surface 262 supports the right circuit board 252*b*. The lower left support surface 264 supports the lower left circuit board 254*b*. The lower right support surface 266 supports the lower right circuit board 256*b*.

Therefore, the heat dissipation member 26 is configured so as to dissipate heat generated by the operations of the left light source 251*a*, the right light source 252*a*, the upper left light source 253*a*, the lower left light source 254*a*, the upper right light source 255*a*, and the lower right light source 256*a*.

The left light source 251*a*, the right light source 252*a*, the upper left light source 253*a*, the lower left light source 254*a*, the upper right light source 255*a*, and the lower right light source 256*a* are disposed at positions facing the hollow portion 268 with the wall portion 267 of the heat dissipation member 26 interposed therebetween.

Figure 9:
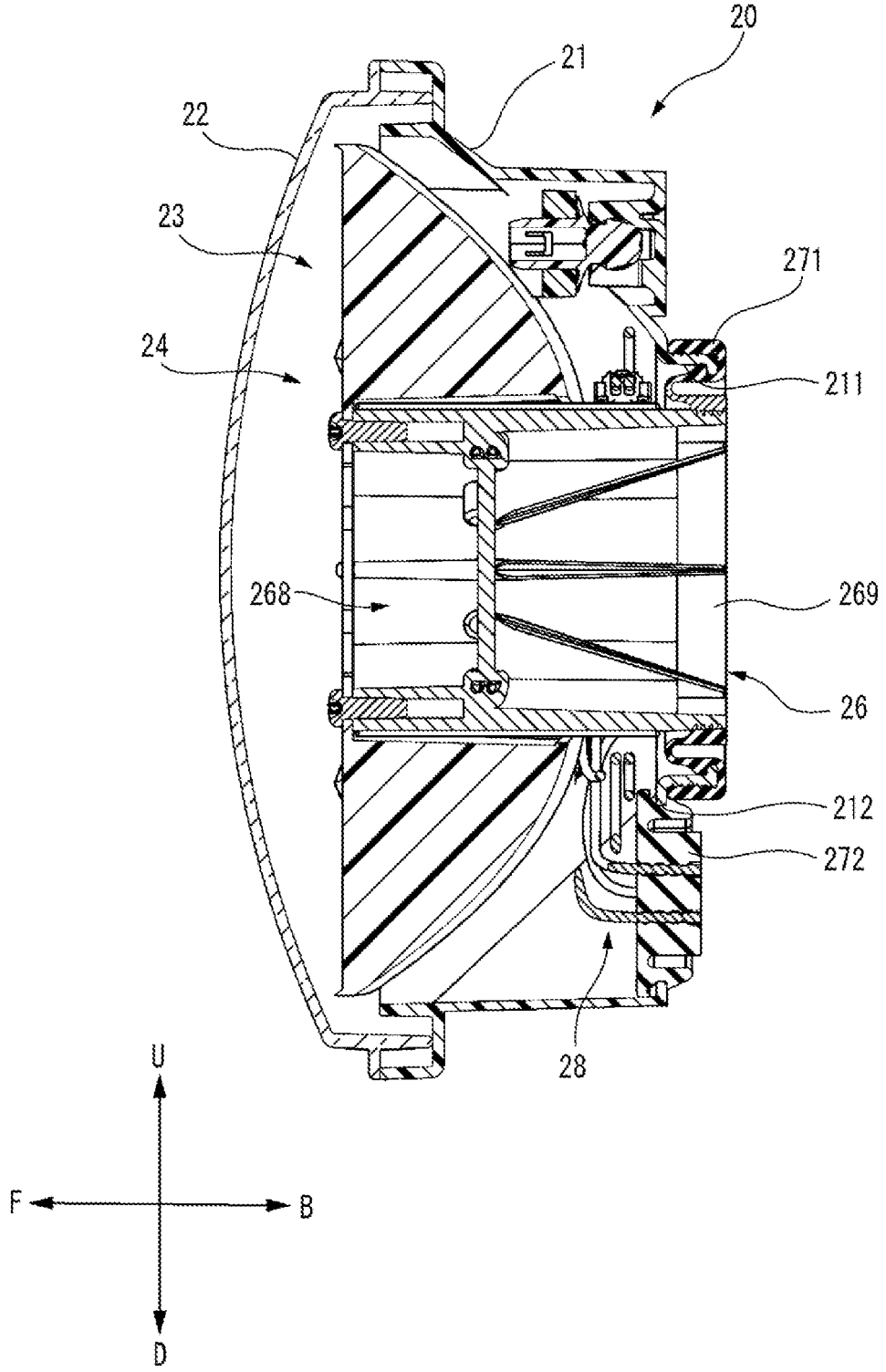
FIG. 9 is a sectional view showing a part of the headlamp in FIG. 1.
Figure 10:
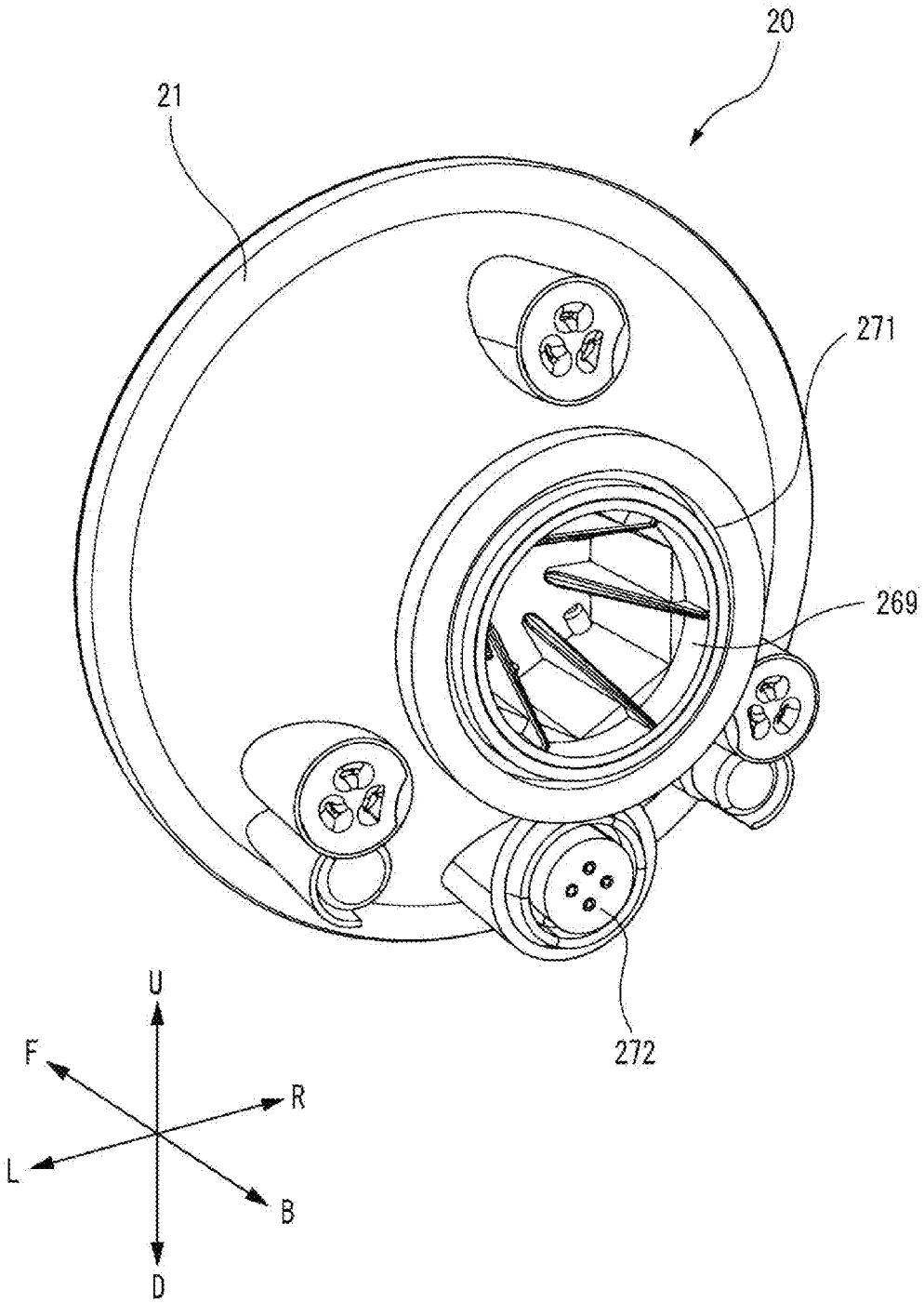
FIG. 10 is a perspective view showing a part of the headlamp in FIG. 1.

FIG. 9 is a sectional view taken along the line V2-V2 in FIG. 2, showing a configuration of the headlamp 20 as viewed from the direction of the arrow. Here, the translucent cover 22 is also shown. FIG. 10 shows an appearance of the headlamp 20 as viewed from the rear left upper.

Most of the heat dissipation member 26 is accommodated in the lamp chamber 23. A rear end portion 269 of the heat dissipation member 26 is exposed to the outside of the headlamp 20 through a first opening 211 formed in a rear portion of the housing 21.

The headlamp 20 includes a first sealing member 271. The first sealing member 271 is formed of an elastically deformable material. The first sealing member 271 seals a gap between the first opening 211 of the housing 21 and the rear end portion 269 of the heat dissipation member 26. The example of the first sealing member 271 can include an O ring or a gasket.

The headlamp 20 includes a second sealing member 272. The second sealing member 272 is formed of an elastically deformable material. The second sealing member 272 is fitted into a second opening 212 formed in a rear portion of the housing 21. The second opening 212 is sealed by the second sealing member 272.

The headlamp 20 includes a plurality of conducting wires 28. The plurality of conducting wires 28 are drawn to the outside of the headlamp 20 through a plurality of through-holes formed in the second sealing member 272. The plurality of conducting wires 28 are electrically connected to a control unit (not shown) on the vehicle side.

As shown in FIGS. 5 and 6, the plurality of conducting wires 28 are connected to the left connector 251*c* of the left light source unit 251, the right connector 252*c* of the right light source unit 252, the upper left connector 253*c* of the upper left light source unit 253, the lower left connector 254*c* of the lower left light source unit 254, the upper right connector 255*c* of the upper right light source unit 255, and the lower right connector 256*c* of the lower right light source unit 256, respectively.

Specifically, the plurality of conducting wires 28 include a conducting wire (an example of the first conducting wire) electrically connected to the left light source 251*a*, a conducting wire (an example of the second conducting wire) electrically connected to the right light source 252*a*, a conducting wire electrically connected to the upper left light source 253*a*, a conducting wire electrically connected to the lower left light source 254*a*, a conducting wire electrically connected to the upper right light source 255*a*, and a conducting wire electrically connected to the lower right light source 256*a*.

As shown in FIG. 9, the reflector member 24 is mounted to the heat dissipation member 26.

As is apparent from FIGS. 3 and 5, the opaque cover portion 247 of the reflector member 24 covers at least a front end of the left circuit board 251*b*, at least a front end of the upper left circuit board 253*b*, and at least a front end of the upper right circuit board 255*b*.

The left reflecting surface 241, the upper left reflecting surface 243, and the upper right reflecting surface 245 of the reflector member 24 cover the left connector 251*c*, the upper left connector 253*c*, and the upper right connector 255*c* at least from the front, respectively. Further, the left reflecting surface 241, the upper left reflecting surface 243, and the upper right reflecting surface 245 of the reflector member 24 cover the plurality of conducting wires 28 connected to the left connector 251*c*, the upper left connector 253*c*, and the upper right connector 255*c* at least from the front.

As is apparent from FIGS. 4 and 6, the opaque cover portion 247 of the reflector member 24 covers at least a front end of the right circuit board 252*b*, at least a front end of the lower left circuit board 254*b*, and at least a front end of the lower right circuit board 256*b*.

The right reflecting surface 242, the lower left reflecting surface 244, and the lower right reflecting surface 246 of the reflector member 24 cover the right connector 252*c*, the lower left connector 254*c*, and the lower right connector 256*c* at least from the front, respectively. Further, the right reflecting surface 242, the lower left reflecting surface 244, and the lower right reflecting surface 246 of the reflector member 24 cover the plurality of conducting wires 28 connected to the right connector 252*c*, the lower left connector 254*c*, and the lower right connector 256*c* at least from the front.

Electric energy (which is at least one of voltage and current and whose value may change over time) supplied from the control unit on the vehicle side is supplied to the left light source 251*a*, the right light source 252*a*, the upper left light source 253*a*, the lower left light source 254*a*, the upper right light source 255*a*, and the lower right light source 256*a* through the plurality of conducting wires 28, respectively.

As is apparent from FIGS. 3 and 5, when electric energy is supplied to the left light source 251*a*, the left light source 251*a* emits light toward the left (an example of a direction intersecting with the front and rear direction). The light emitted from the left light source 251*a* is reflected toward the front (an example of a predetermined direction) by the left reflecting surface 241 of the reflector member 24. The reflected light passes through the translucent cover 22 and illuminates the front of the headlamp 20.

Similarly, when electric energy is supplied to the upper left light source 253*a* (an example of the third light source), the upper left light source 253*a* emits light toward the left upper (an example of a direction intersecting with the front and rear direction). The light emitted from the upper left light source 253*a* is reflected toward the front by the upper left reflecting surface 243 of the reflector member 24. The reflected light passes through the translucent cover 22 and illuminates the front of the headlamp 20.

Similarly, when electric energy is supplied to the upper right light source 255*a* (an example of the third light source), the upper right light source 255*a* emits light toward the right upper (an example of a direction intersecting with the front and rear direction). The light emitted from the upper right light source 255*a* is reflected toward the front by the upper right reflecting surface 245 of the reflector member 24. The reflected light passes through the translucent cover 22 and illuminates the front of the headlamp 20.

As is apparent from FIGS. 4 and 6, when electric energy is supplied to the right light source 252*a*, the right light source 252*a* emits light toward the right (an example of a direction intersecting with the front and rear direction). The light emitted from the right light source 252*a* is reflected toward the front (an example of a predetermined direction) by the right reflecting surface 242 of the reflector member 24. The reflected light passes through the translucent cover 22 and illuminates the front of the headlamp 20.

Similarly, when electric energy is supplied to the lower left light source 254*a* (an example of the third light source), the lower left light source 254*a* emits light toward the left lower (an example of a direction intersecting with the front and rear direction). The light emitted from the lower left light source 254*a* is reflected toward the front by the lower left reflecting surface 244 of the reflector member 24. The reflected light passes through the translucent cover 22 and illuminates the front of the headlamp 20.

Similarly, when electric energy is supplied to the lower right light source 256*a* (an example of the third light source), the lower right light source 256*a* emits light toward the right lower (an example of a direction intersecting with the front and rear direction). The light emitted from the lower right light source 256*a* is reflected toward the front upper by the lower right reflecting surface 246 of the reflector member 24. The reflected light passes through the translucent cover 22 and illuminates the front of the headlamp 20.

As described above, the headlamp 20 according to the present embodiment includes the reflector member 24, the left light source 251*a*, the right light source 252*a*, and the heat dissipation member 26. The heat dissipation member 26 has the wall portion 267 defining the hollow portion 268. The heat dissipation member 26 dissipates heat generated by the operations of the left light source 251*a* and the right light source 252*a*. The reflector member 24 is mounted to the heat dissipation member 26. The left light source 251*a* and the right light source 252*a* are disposed at positions facing the hollow portion 268 with the wall portion 267 interposed therebetween, respectively. Each of the left light source 251*a* and the right light source 252*a* emits light in a direction intersecting with the front and rear direction of the headlamp 20. The reflector member 24 is an integrally molded product and has the left reflecting surface 241 and the right reflecting surface 242. The left reflecting surface 241 reflects light emitted from the left light source 251*a* in a predetermined direction. The right reflecting surface 242 reflects light emitted from the right light source 252*a* in a predetermined direction.

According to the above configuration, the light emitted from the left light source 251*a* is reflected by the left reflecting surface 241 of the reflector member 24, and the light emitted from the right light source 252*a* is reflected by the right reflecting surface 242 of the reflector member 24. Since the space spreading in a direction intersecting with the front and rear direction of the headlamp 20 having a relatively high degree of freedom of layout can be effectively utilized, it is easy to suppress an increase in the size in the front and rear direction, as compared to the configuration as disclosed in Patent Document in which the distribution of the light emitted forward from the light source is controlled by a lens part formed in the translucent cover.

Further, since the left light source 251*a* and the right light source 252*a* are disposed at positions facing the hollow portion 268 of the heat dissipation member 26 having a large surface area, the heat generated by the operations of the left light source 251*a* and the right light source 252*a* can be effectively dissipated. Therefore, the volume of the heat dissipation member 26 necessary for obtaining desired heat dissipation performance can be reduced, and an increase in the size of the headlamp 20 can be suppressed.

Furthermore, since the left reflecting surface 241 and the right reflecting surface 242 are parts of a single reflector member 24, the number of steps for mounting to the heat dissipation member 26 can be minimized.

In the present embodiment, the headlamp 20 includes the plurality of conducting wires 28 electrically connected to the left light source 251*a* and the right light source 252*a*. The plurality of conducting wires 28 are arranged behind the reflector member 24.

According to this configuration, the reflector member 24 mounted to the heat dissipation member 26 can have a function of covering and concealing the plurality of conducting wires 28. In this way, the number of parts is reduced, and an increase in the size of the headlamp 20 can be suppressed.

The above description can be similarly applied to other light sources provided in the headlamp 20.

In the present embodiment, the left light source 251*a*, the right light source 252*a*, the upper left light source 253*a*, the lower left light source 254*a*, the upper right light source 255*a*, and the lower right light source 256*a* emit light in directions intersecting with the front and rear direction of the headlamp 20.

According to such a configuration, three or more light sources can be arranged with high space utilization efficiency. In this way, an increase in the size of the headlamp 20 can be suppressed.

The above embodiment is merely an example for facilitating the understanding of the disclosure. The configuration according to the above embodiment can be appropriately modified and improved without departing from the gist of the disclosure.

In the first embodiment, the single reflector member 24 mounted to the heat dissipation member 26 has the left reflecting surface 241, the right reflecting surface 242, the upper left reflecting surface 243, the lower left reflecting surface 244, the upper right reflecting surface 245, and the lower right reflecting surface 246. However, the reflector member 24 may be formed by integrating a plurality of subunits, and each subunit may have a plurality of reflecting surfaces which reflect light emitted from a plurality of light sources disposed at positions facing the hollow portion 268 with the wall portion 267 of the heat dissipation member 26 interposed therebetween.

In the first embodiment, the plurality of conducting wires 28 are electrically connected to the left light source 251*a*, the right light source 252*a*, the upper left light source 253*a*, the lower left light source 254*a*, the upper right light source 255*a*, and the lower right light source 256*a* via the left connector 251*c*, the right connector 252*c*, the upper left connector 253*c*, the lower left connector 254*c*, the upper right connector 255*c*, and the lower right connector 256*c*, respectively. However, the plurality of conducting wires 28 may be electrically connected to the respective light sources by soldering or the like to the contacts without connectors.

In the first embodiment, the left reflecting surface 241, the right reflecting surface 242, the upper left reflecting surface 243, the lower left reflecting surface 244, the upper right reflecting surface 245, and the lower right reflecting surface 246 of the reflector member 24 are configured so that all of the left light source 251*a*, the right light source 252*a*, the upper left light source 253*a*, the lower left light source 254*a*, the upper right light source 255*a*, and the lower right light source 256*a* illuminate the front. However, the area illuminated by each light source can be appropriately determined according to the specifications of the headlamp. For example, the left reflecting surface 241 and the right reflecting surface 242 of the reflector member 24 may be configured so that the left light source 251*a* and the right light source 252*a* illuminate different areas in front of the headlamp 20.

In the first embodiment, the headlamp 20 is exemplified as an example of the lighting device. However, the disclosure may be applied to various lighting devices which are configured to be mounted on a vehicle and include a plurality of light sources and a heat dissipation member. The front and rear direction, the left and right direction, and the upper and lower direction of the headlamp 20 are coincident with the front and rear direction, the left and right direction, and the upper and lower direction of the vehicle, respectively. However, depending on the lighting device to which the disclosure is applied, at least one of the front and rear direction, the left and right direction, and the upper and lower direction of the lighting device is not coincident with the front and rear direction, the left and right direction, and the upper and lower direction of the vehicle.

Figure 11:
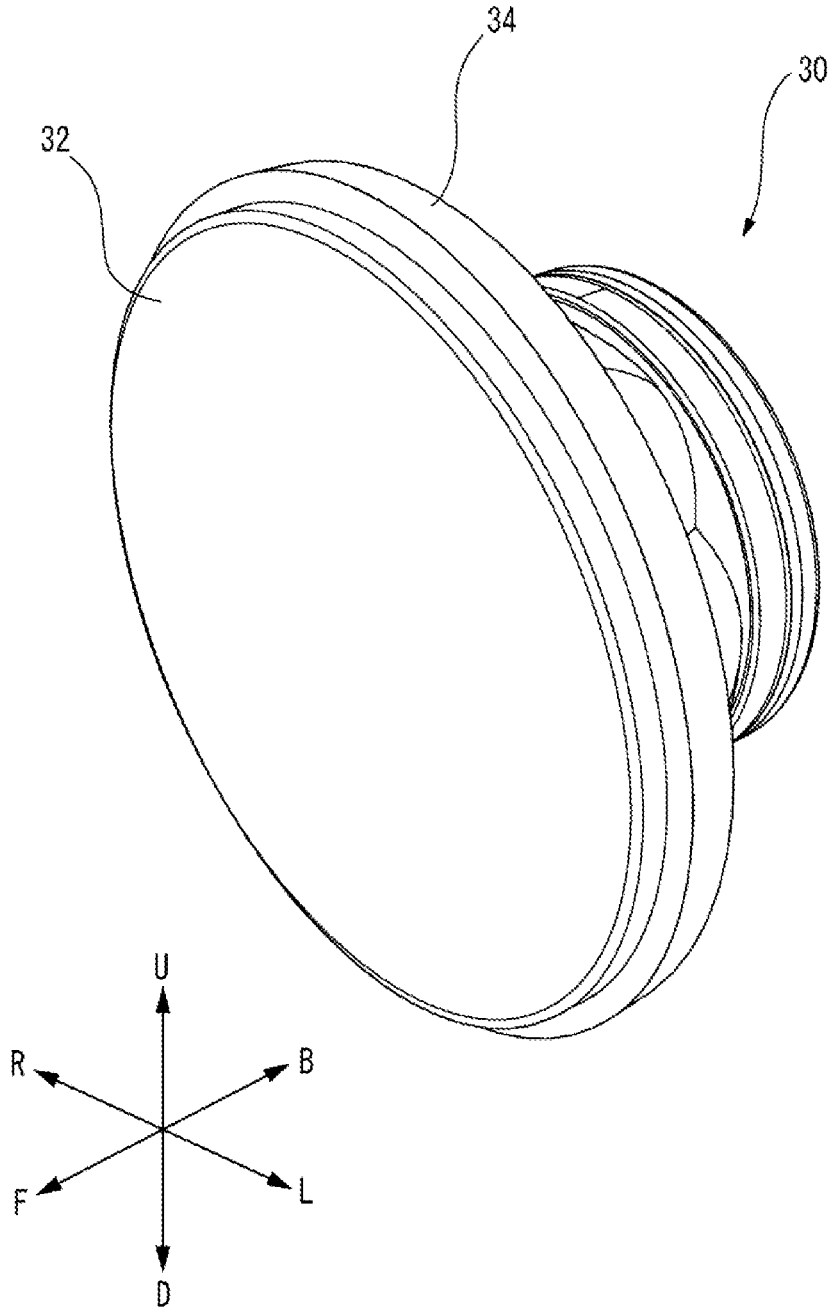
FIG. 11 is a perspective view showing a headlamp according to a second embodiment.

FIG. 11 shows an appearance of a headlamp 30 (an example of the lighting device) according to a second embodiment as viewed from the front left upper. The headlamp 30 is mounted on a front portion of a vehicle. The headlamp 30 includes a translucent cover 32 and a reflector member 34.

Figure 12:
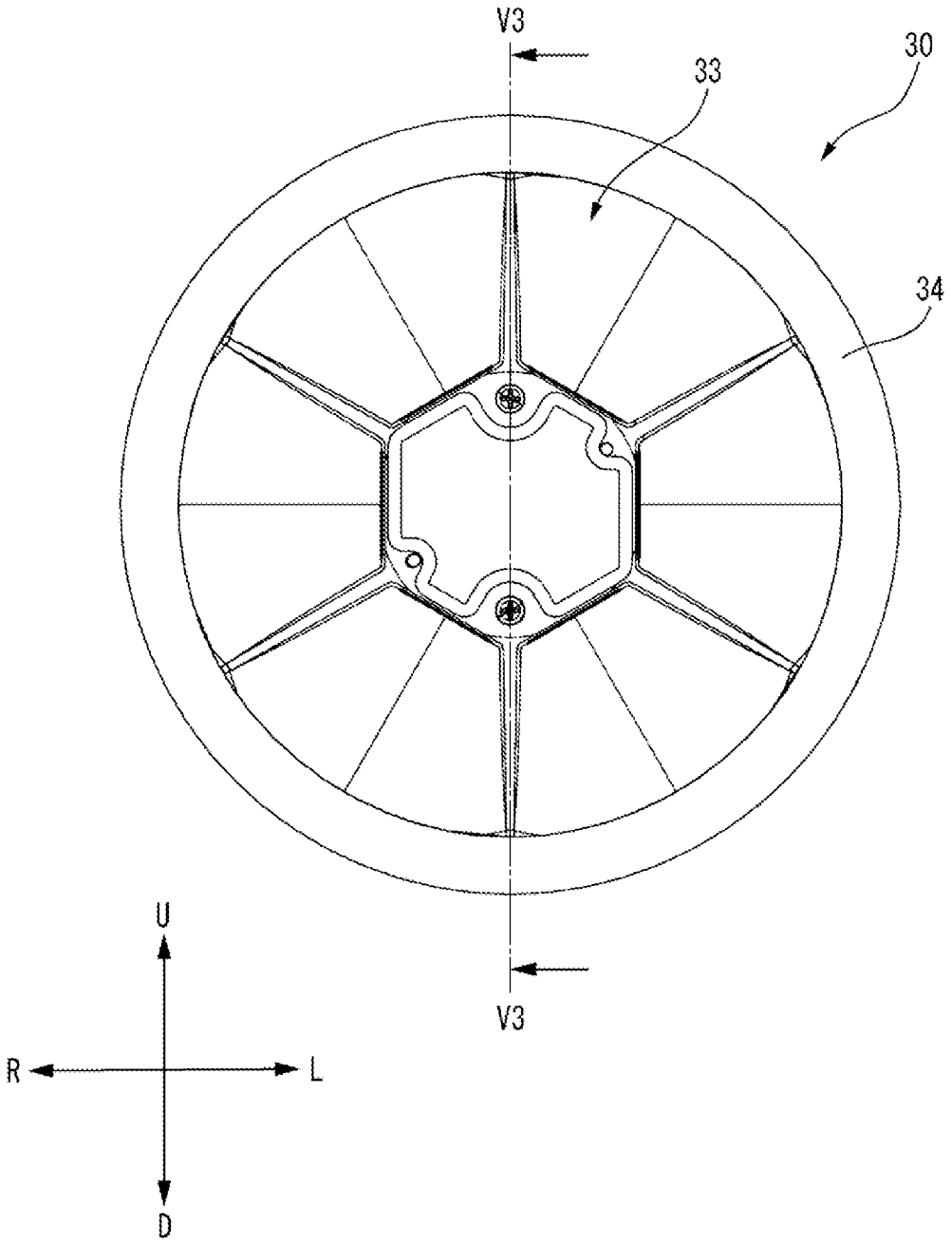
FIG. 12 is a front view showing a part of the headlamp in FIG. 11.

FIG. 12 is a front view showing an appearance of the headlamp 30 from which the translucent cover 32 is removed from the state shown in FIG. 11. The translucent cover 32 is mounted to the reflector member 34 and defines a lamp chamber 33.

Figure 13:
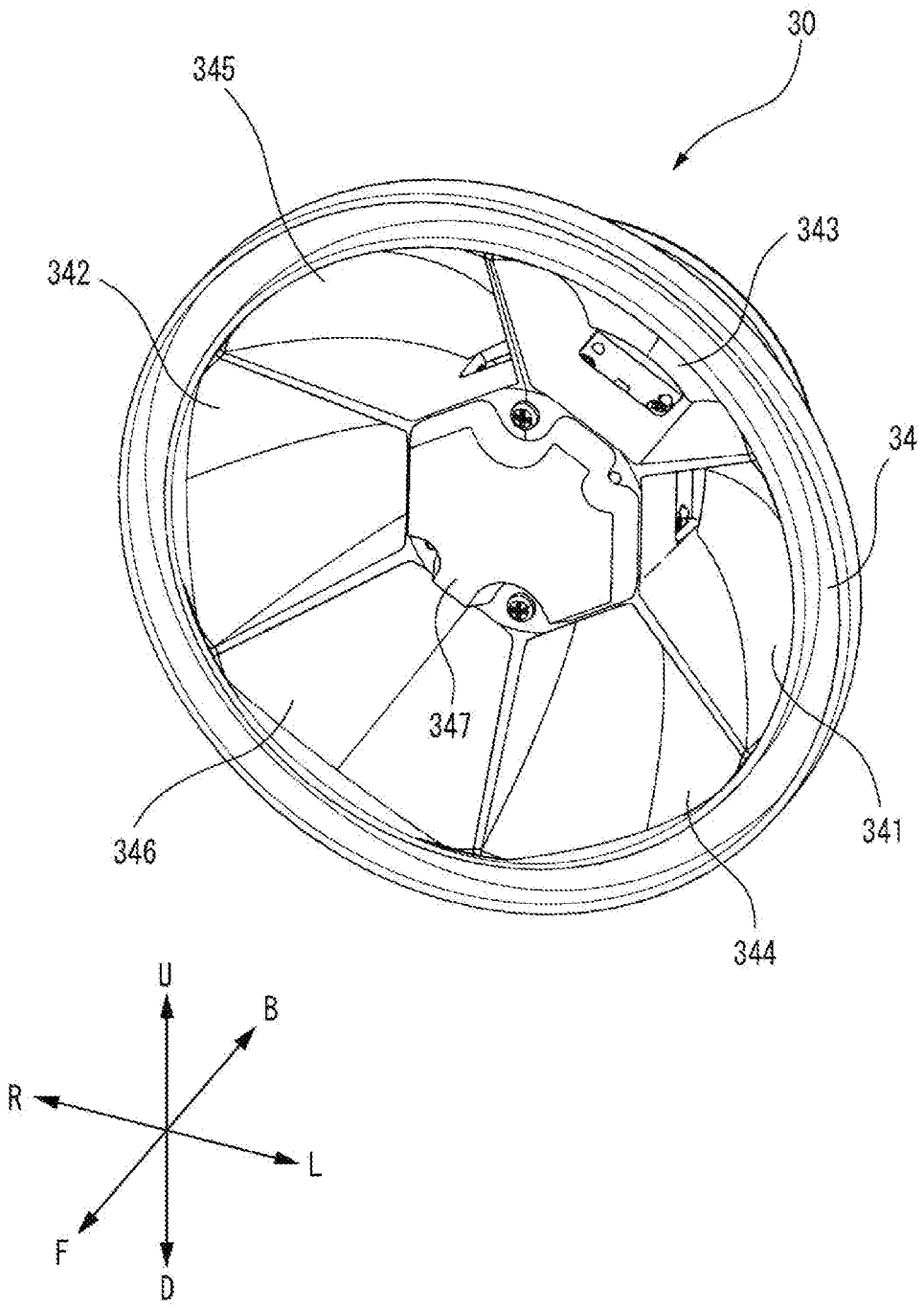
FIG. 13 is a perspective view showing a part of the headlamp in FIG. 11.
Figure 14:
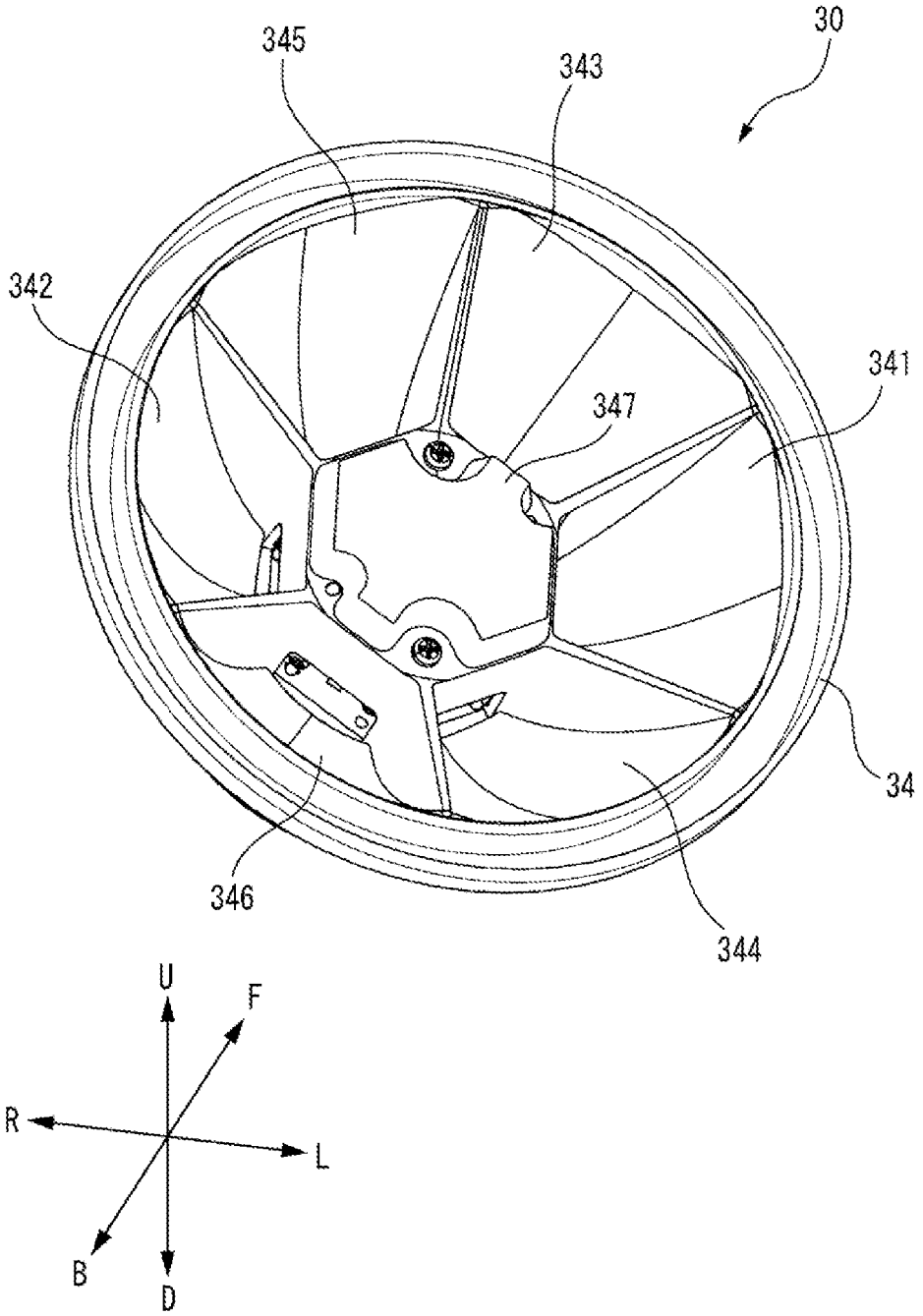
FIG. 14 is a perspective view showing a part of the headlamp in FIG. 11.

FIG. 13 shows an appearance of the headlamp 30 in the state shown in FIG. 12, as viewed from the front left upper. FIG. 14 shows an appearance of the headlamp 30 in the state shown in FIG. 12, as viewed from the front right lower.

The reflector member 34 is an integrally molded product made of resin or the like. The reflector member 34 has a left reflecting surface 341 (an example of the first reflecting surface), a right reflecting surface 342 (an example of the second reflecting surface), an upper left reflecting surface 343, a lower left reflecting surface 344, an upper right reflecting surface 345, a lower right reflecting surface 346, and an opaque cover portion 347.

Figure 15:
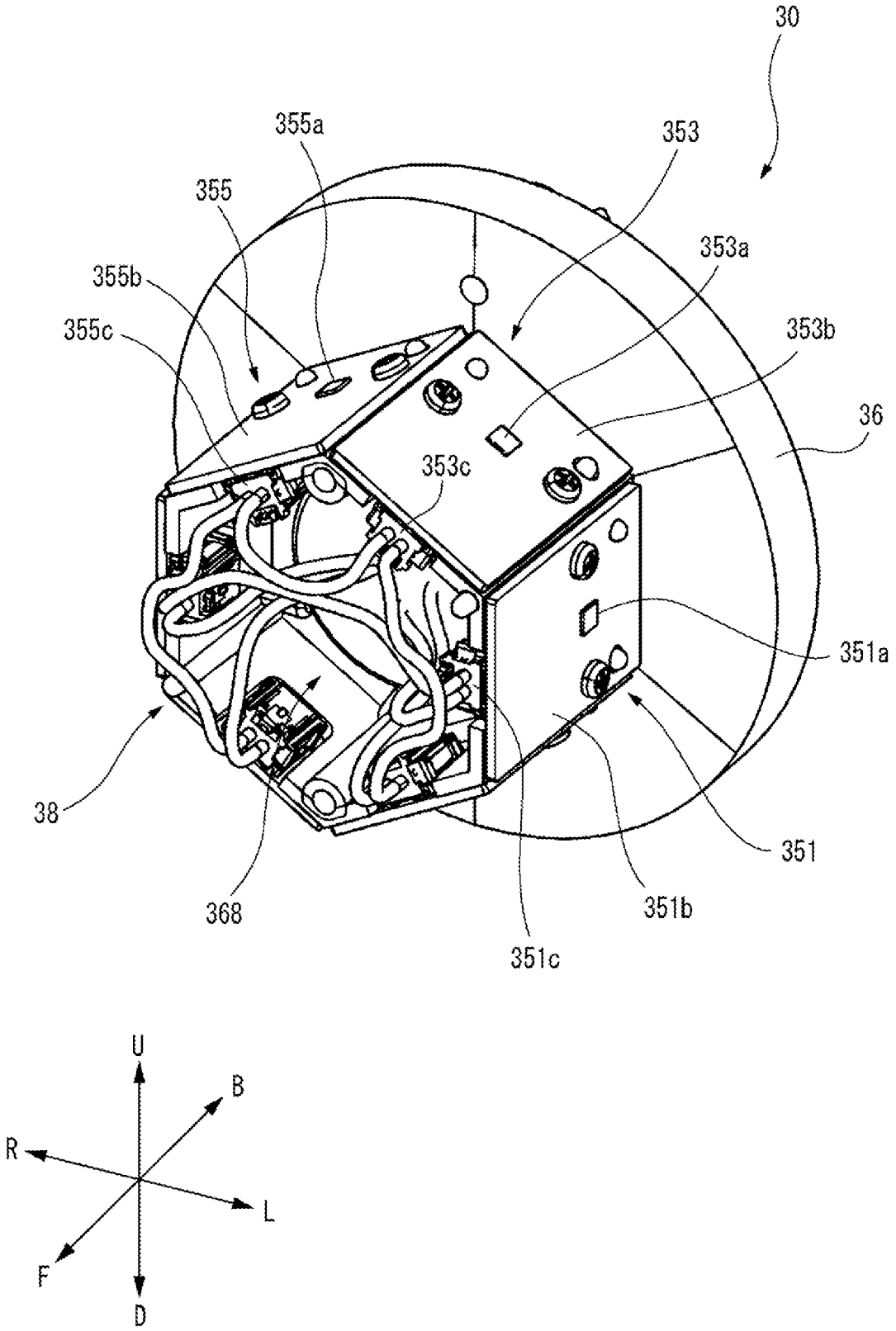
FIG. 15 is a perspective view showing a part of the headlamp in FIG. 11.
Figure 16:
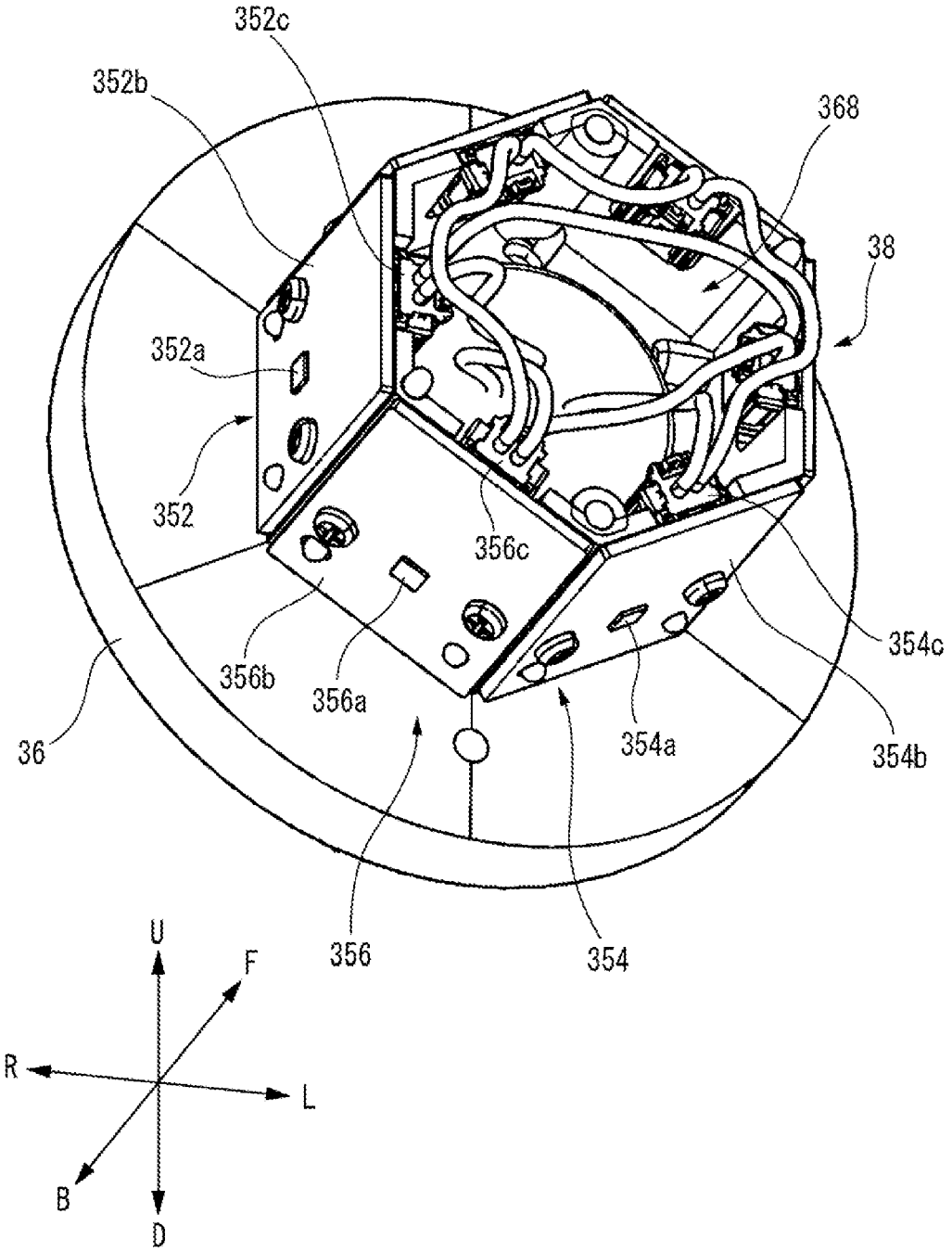
FIG. 16 is a perspective view showing a part of the headlamp in FIG. 11.

FIG. 15 shows an appearance of the headlamp 30 from which the reflector member 34 is removed from the state shown in FIG. 13, as viewed from the front left upper. FIG. 16 shows an appearance of the headlamp 30 from which the reflector member 34 is removed from the state shown in FIG. 14, as viewed from the front right lower.

The headlamp 30 includes a left light source unit 351, a right light source unit 352, an upper left light source unit 353, a lower left light source unit 354, an upper right light source unit 355, and a lower right light source unit 356.

The left light source unit 351 includes a left light source 351*a* (an example of the first light source), a left circuit board 351*b*, and a left connector 351*c*. The left circuit board 351*b* supports the left light source 351*a* and the left connector 351*c*. The left circuit board 351*b* has a circuit for electrically connecting the left light source 351*a* and the left connector 351*c*.

The right light source unit 352 includes a right light source 352*a* (an example of the second light source), a right circuit board 352*b*, a right connector 352*c*. The right circuit board 352*b* supports the right light source 352*a* and the right connector 352*c*. The right circuit board 352*b* has a circuit for electrically connecting the right light source 352*a* and the right connector 352*c*.

The upper left light source unit 353 includes an upper left light source 353*a*, an upper left circuit board 353*b*, and an upper left connector 353*c*. The upper left circuit board 353*b* supports the upper left light source 353*a* and the upper left connector 353*c*. The upper left circuit board 353*b* has a circuit for electrically connecting the upper left light source 353*a* and the upper left connector 353*c*.

The lower left light source unit 354 includes a lower left light source 354*a*, a lower left circuit board 354*b*, and a lower left connector 354*c*. The lower left circuit board 354*b* supports the lower left light source 354*a* and the lower left connector 354*c*. The lower left circuit board 354*b* has a circuit for electrically connecting the lower left light source 354*a* and the lower left connector 354*c*.

The upper right light source unit 355 includes an upper right light source 355*a*, an upper right circuit board 355*b*, and an upper right connector 355*c*. The upper right circuit board 355*b* supports the upper right light source 355*a* and the upper right connector 355*c*. The upper right circuit board 355*b* has a circuit for electrically connecting the upper right light source 355*a* and the upper right connector 355*c*.

The lower right light source unit 356 includes a lower right light source 356*a*, a lower right circuit board 356*b*, and a lower right connector 356*c*. The lower right circuit board 356*b* supports the lower right light source 356*a* and the lower right connector 356*c*. The lower right circuit board 356*b* has a circuit for electrically connecting the lower right light source 356*a* and the lower right connector 356*c*.

The left light source 351*a*, the right light source 352*a*, the upper left light source 353*a*, the lower left light source 354*a*, the upper right light source 355*a*, and the lower right light source 356*a* are semiconductor light emitting elements for emitting light having a predetermined wavelength. Examples of the semiconductor light emitting element can include a light emitting diode (LED), a laser diode (LD), an organic EL element, or the like.

Figure 17:
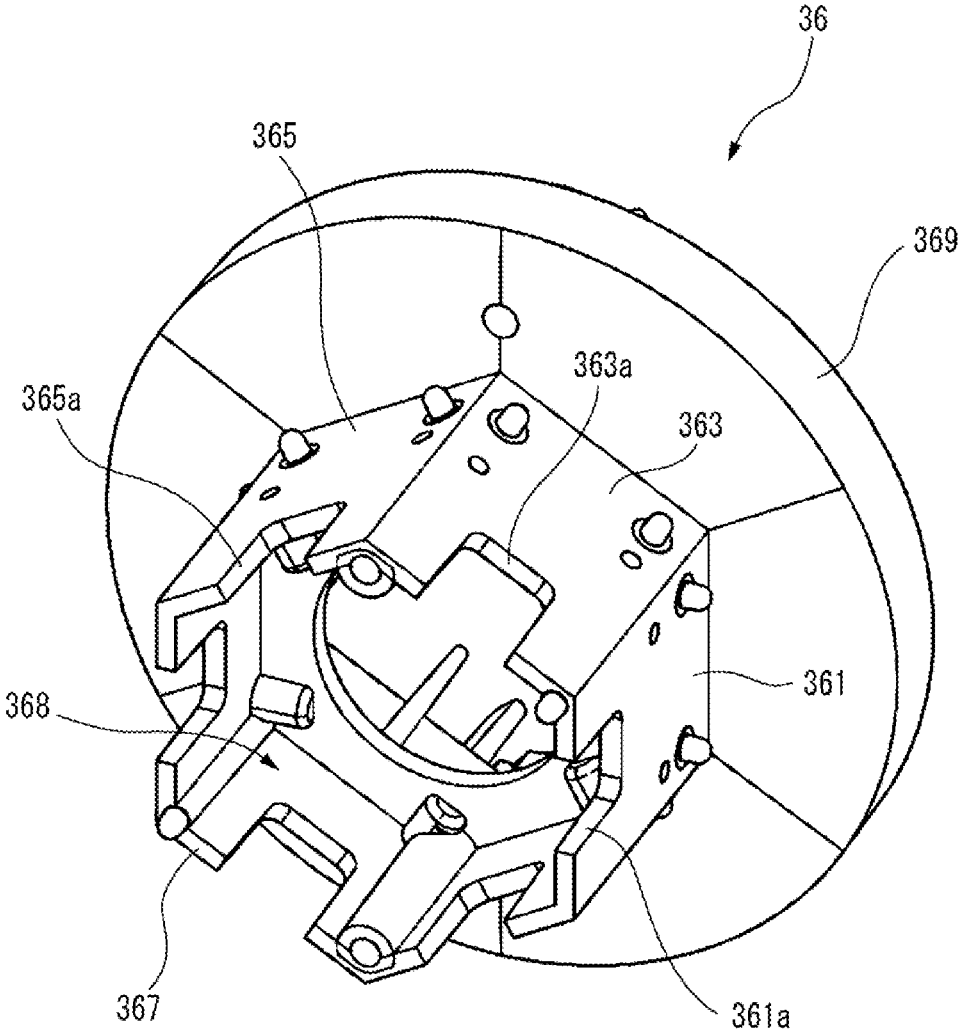
FIG. 17 is a perspective view showing a heat dissipation member in the headlamp in FIG. 11.
Figure 17:
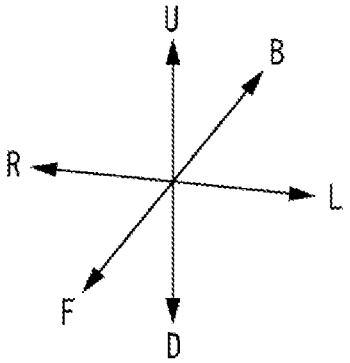
Figure 18:
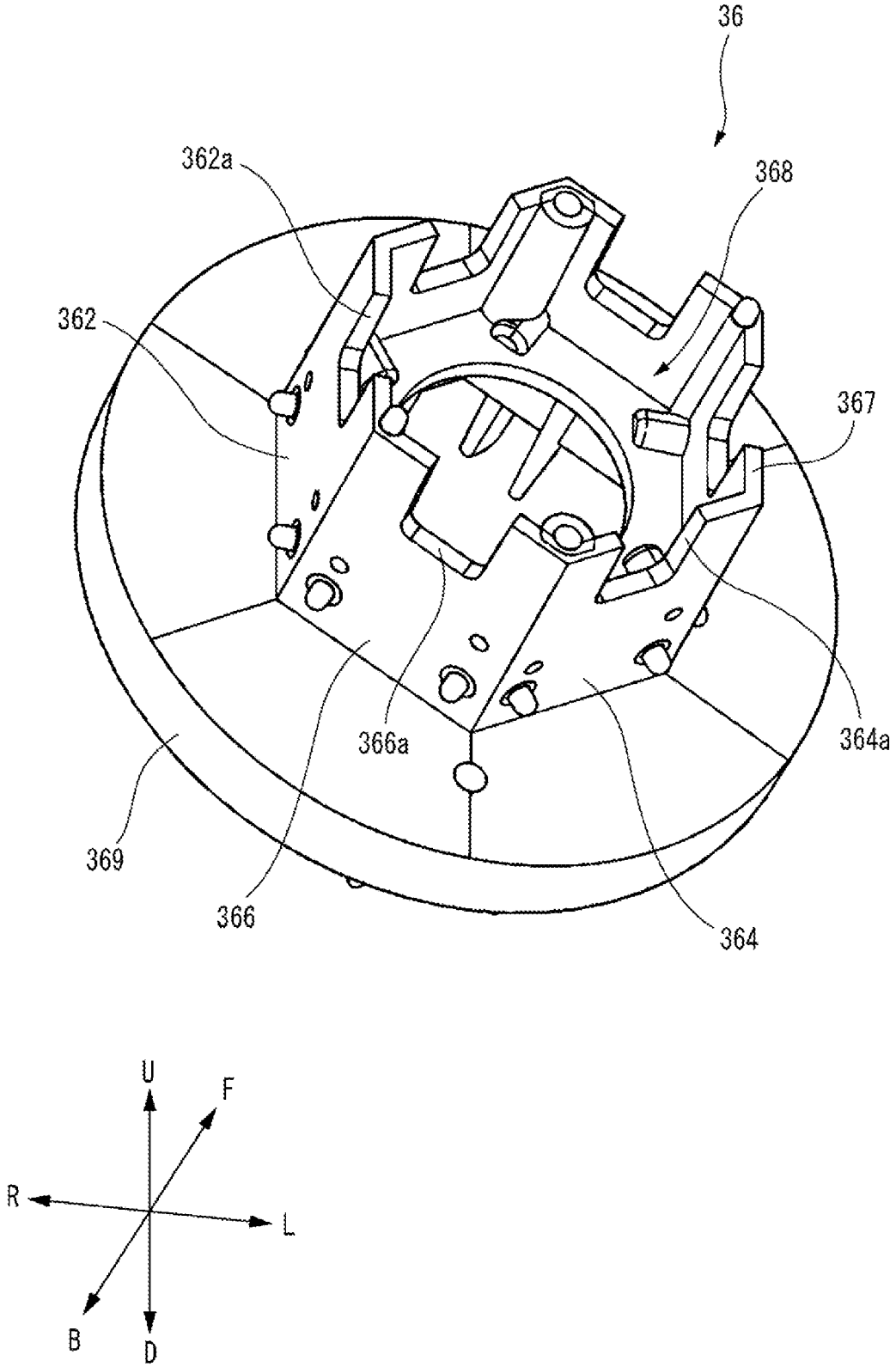
FIG. 18 is a perspective view showing the heat dissipation member in the headlamp in FIG. 11.

The headlamp 30 includes a heat dissipation member 36. The heat dissipation member 36 is formed of a material having a relatively high thermal conductivity, such as metal. FIG. 17 shows an appearance of the heat dissipation member 36 as viewed from the front left upper. FIG. 18 shows an appearance of the heat dissipation member 36 as viewed from the front right lower.

The heat dissipation member 36 has a left support surface 361, a right support surface 362, an upper left support surface 363, a lower left support surface 364, an upper right support surface 365, and a lower right support surface 366.

The left support surface 361 is a flat surface facing the left. The upper left support surface 363 is a flat surface facing the left upper. The upper left support surface 363 is positioned on the right side and on the upper side of the left support surface 361. The lower left support surface 364 is a flat surface facing the left lower. The lower left support surface 364 is positioned on the right side and on the lower side of the left support surface 361.

The right support surface 362 is a flat surface facing the right. The upper right support surface 365 is a flat surface facing the right upper. The upper right support surface 365 is positioned on the left side and on the upper side of the right support surface 362. The lower right support surface 366 is a flat surface facing the right lower. The lower right support surface 366 is positioned on the left side and on the lower side of the right support surface 362.

The heat dissipation member 36 has a wall portion 367. The wall portion 367 defines a hollow portion 368 which is a through-hole opened in the front and rear direction. The left support surface 361, the right support surface 362, the upper left support surface 363, the upper right support surface 365, the lower left support surface 364, and the lower right support surface 366 are parts of the wall portion 367.

As is apparent from FIGS. 15 and 17, the left support surface 361 supports the left circuit board 351*b*. The upper left support surface 363 supports the upper left circuit board 353*b*. The upper right support surface 365 supports the upper right circuit board 355*b*.

As is apparent from FIGS. 16 and 18, the right support surface 362 supports the right circuit board 352*b*. The lower left support surface 364 supports the lower left circuit board 354*b*. The lower right support surface 366 supports the lower right circuit board 356*b*.

Therefore, the heat dissipation member 36 is configured so as to dissipate heat generated by the operations of the left light source 351*a*, the right light source 352*a*, the upper left light source 353*a*, the lower left light source 354*a*, the upper right light source 355*a*, and the lower right light source 356*a*.

The left light source 351*a*, the right light source 352*a*, the upper left light source 353*a*, the lower left light source 354*a*, the upper right light source 355*a*, and the lower right light source 356*a* are disposed at positions facing the hollow portion 368 with the wall portion 367 of the heat dissipation member 36 interposed therebetween.

A part of the wall portion 367 forming the left support surface 361 has a left recessed portion 361*a*. The left recessed portion 361*a* is opened to the front. When the left circuit board 351*b* is mounted to the left support surface 361, the left connector 351*c* is accommodated in the left recessed portion 361*a*. The left connector 351*c* is disposed in the hollow portion 368.

A part of the wall portion 367 forming the right support surface 362 has a right recessed portion 362*a*. The right recessed portion 362*a* is opened to the front. When the right circuit board 352*b* is mounted to the right support surface 362, the right connector 352*c* is accommodated in the right recessed portion 362*a*. The right connector 352*c* is disposed in the hollow portion 368.

Apart of the wall portion 367 forming the upper left support surface 363 has an upper left recessed portion 363*a*. The upper left recessed portion 363*a* is opened to the front. When the upper left circuit board 353*b* is mounted to the upper left support surface 363, the upper left connector 353*c* is accommodated in the upper left recessed portion 363*a*. The upper left connector 353*c* is disposed in the hollow portion 368.

A part of the wall portion 367 forming the lower left support surface 364 has a lower left recessed portion 364*a*. The lower left recessed portion 364*a* is opened to the front. When the lower left circuit board 354*b* is mounted to the lower left support surface 364, the lower left connector 354*c* is accommodated in the lower left recessed portion 364*a*. The lower left connector 354*c* is disposed in the hollow portion 368.

A part of the wall portion 367 forming the upper right support surface 365 has an upper right recessed portion 365*a*. The upper right recessed portion 365*a* is opened to the front. When the upper right circuit board 355*b* is mounted to the upper right support surface 365, the upper right connector 355*c* is accommodated in the upper right recessed portion 365*a*. The upper right connector 355*c* is disposed in the hollow portion 368.

A part of the wall portion 367 forming the lower right support surface 366 has a lower right recessed portion 366*a*. The lower right recessed portion 366*a* is opened to the front. When the lower right circuit board 356*b* is mounted to the lower right support surface 366, the lower right connector 356*c* is accommodated in the lower right recessed portion 366*a*. The lower right connector 356*c* is disposed in the hollow portion 368.

Figure 19:
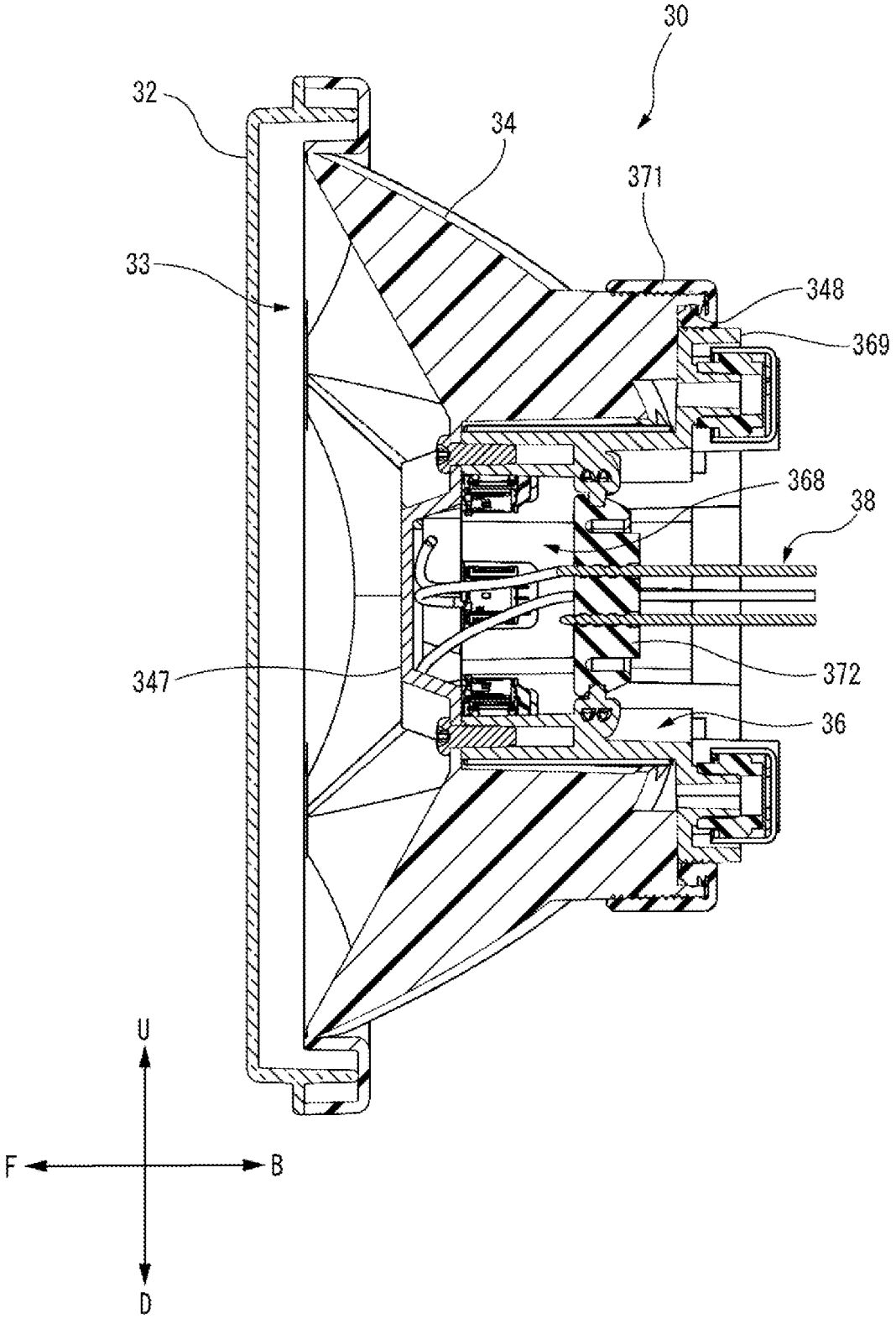
FIG. 19 is a sectional view showing a part of the headlamp in FIG. 11.
Figure 20:
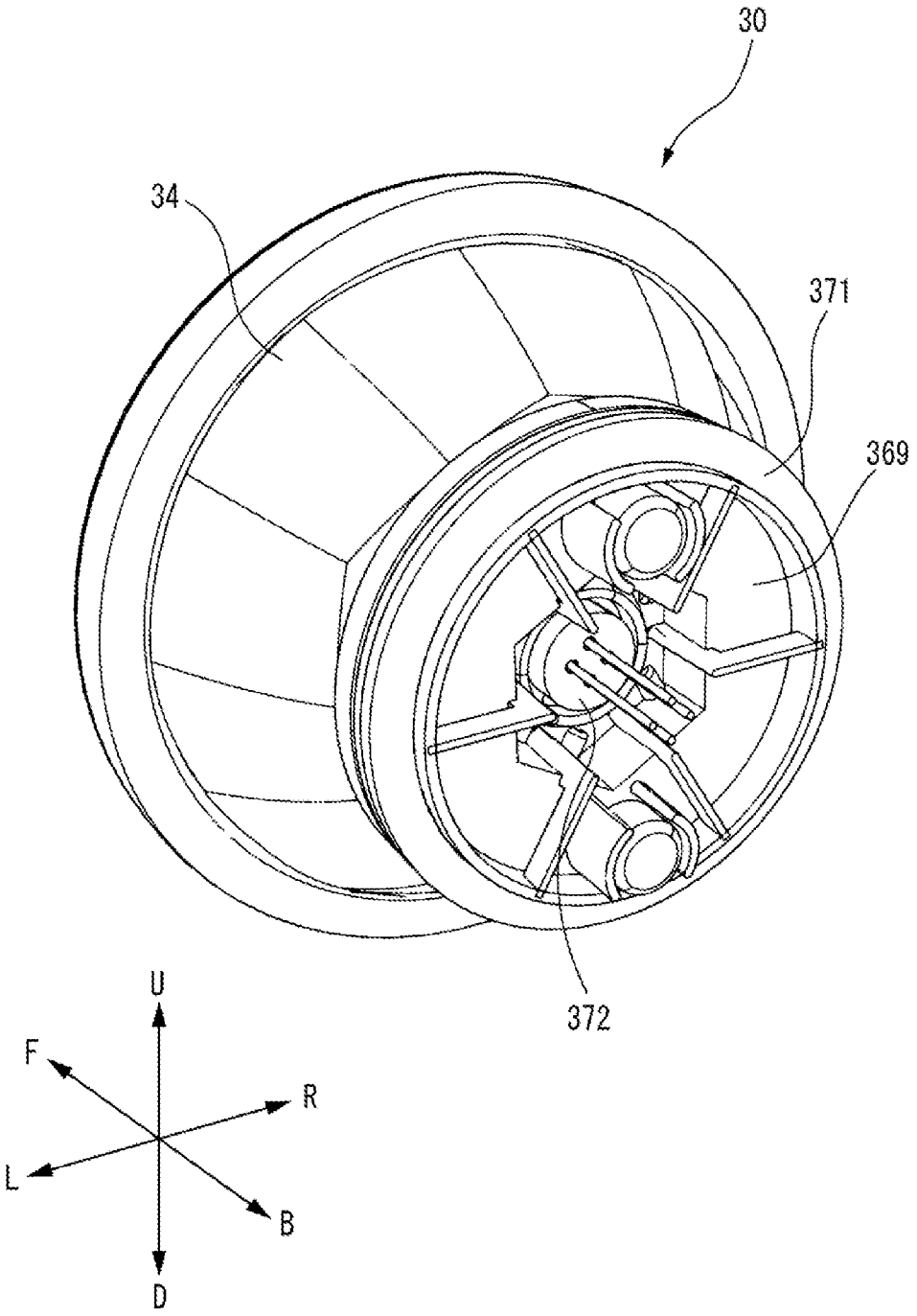
FIG. 20 is a perspective view showing a part of the headlamp in FIG. 11.

FIG. 19 is a sectional view taken along the line V3-V3 in FIG. 12, showing a configuration of the headlamp 30 as viewed from the direction of the arrow. Here, the translucent cover 32 is also shown. FIG. 20 shows an appearance of the headlamp 30 as viewed from the rear left upper.

Most of the heat dissipation member 36 is accommodated in the lamp chamber 33. A rear end portion 369 of the heat dissipation member 36 is exposed to the outside of the headlamp 30 through an opening 348 formed in a rear portion of the reflector member 34.

The headlamp 30 includes a first sealing member 371. The first sealing member 371 is formed of an elastically deformable material. The first sealing member 371 seals a gap between the opening 348 of the reflector member 34 and the rear end portion 369 of the heat dissipation member 36. The example of the first sealing member 371 can include an O ring or a gasket.

The headlamp 20 includes a second sealing member 372. The second sealing member 372 is formed of an elastically deformable material. The second sealing member 372 is fitted into a rear portion of the hollow portion 368 of the heat dissipation member 36. The rear portion of the hollow portion 368 is sealed by the second sealing member 372.

The headlamp 30 includes a plurality of conducting wires 38. The plurality of conducting wires 38 are drawn to the outside of the headlamp 30 through a plurality of through-holes formed in the second sealing member 372. The plurality of conducting wires 38 are electrically connected to a control unit (not shown) on the vehicle side.

As shown in FIGS. 15 and 16, the plurality of conducting wires 38 extends in the hollow portion 368 of the heat dissipation member 36. The plurality of conducting wires 38 are electrically connected, from the front, to the left connector 351*c* of the left light source unit 351, the right connector 352*c* of the right light source unit 352, the upper left connector 353*c* of the upper left light source unit 353, the lower left connector 354*c* of the lower left light source unit 354, the upper right connector 355*c* of the upper right light source unit 355, and the lower right connector 356*c* of the lower right light source unit 356, respectively.

Specifically, the plurality of conducting wires 38 include a conducting wire (an example of the first conducting wire) electrically connected to the left light source 351*a*, a conducting wire (an example of the second conducting wire) electrically connected to the right light source 352*a*, a conducting wire electrically connected to the upper left light source 353*a*, a conducting wire electrically connected to the lower left light source 354*a*, a conducting wire electrically connected to the upper right light source 355*a*, and a conducting wire electrically connected to the lower right light source 356*a*.

As shown in FIG. 19, the reflector member 34 is mounted to the heat dissipation member 36.

As is apparent from FIGS. 13 and 15, the left connector 351*c*, the upper left connector 353*c*, and the upper right connector 355*c* are arranged in front of the left reflecting surface 341, the upper left reflecting surface 343, and the upper right reflecting surface 345 of the reflector member 34, respectively.

The opaque cover portion 347 of the reflector member 34 covers at least a front end of the left circuit board 351*b*, at least a front end of the upper left circuit board 353*b*, and at least a front end of the upper right circuit board 355*b*. Further, the opaque cover portion 347 covers the left connector 351*c*, the upper left connector 353*c*, the upper right connector 355*c*, and the plurality of conducting wires 38 connected to these connectors at least from the front.

As is apparent from FIGS. 14 and 16, the right connector 352*c*, the lower left connector 354*c*, and the lower right connector 356*c* are arranged in front of the right reflecting surface 342, the lower left reflecting surface 344, and the lower right reflecting surface 346 of the reflector member 34, respectively.

The opaque cover portion 347 of the reflector member 34 covers at least a front end of the right circuit board 352*b*, at least a front end of the lower left circuit board 354*b*, and at least a front end of the lower right circuit board 356*b*. Further, the opaque cover portion 347 covers the right connector 352*c*, the lower left connector 354*c*, the lower right connector 356*c*, and the plurality of conducting wires 38 connected to these connectors at least from the front.

Electric energy (which is at least one of voltage and current and whose value may change over time) supplied from the control unit on the vehicle side is supplied to the left light source 351*a*, the right light source 352*a*, the upper left light source 353*a*, the lower left light source 354*a*, the upper right light source 355*a*, and the lower right light source 356*a* through the plurality of conducting wires 38, respectively.

As is apparent from FIGS. 13 and 15, when electric energy is supplied to the left light source 351*a*, the left light source 351*a* emits light toward the left (an example of a direction intersecting with the front and rear direction). The light emitted from the left light source 351*a* is reflected toward the front (an example of a predetermined direction) by the left reflecting surface 341 of the reflector member 34. The reflected light passes through the translucent cover 32 and illuminates the front of the headlamp 30.

Similarly, when electric energy is supplied to the upper left light source 353*a* (an example of the third light source), the upper left light source 353*a* emits light toward the left upper (an example of a direction intersecting with the front and rear direction). The light emitted from the upper left light source 353*a* is reflected toward the front by the upper left reflecting surface 343 of the reflector member 34. The reflected light passes through the translucent cover 32 and illuminates the front of the headlamp 30.

Similarly, when electric energy is supplied to the upper right light source 355*a* (an example of the third light source), the upper right light source 355*a* emits light toward the right upper (an example of a direction intersecting with the front and rear direction). The light emitted from the upper right light source 355*a* is reflected toward the front by the upper right reflecting surface 345 of the reflector member 34. The reflected light passes through the translucent cover 32 and illuminates the front of the headlamp 30.

As is apparent from FIGS. 14 and 16, when electric energy is supplied to the right light source 352*a*, the right light source 352*a* emits light toward the right (an example of a direction intersecting with the front and rear direction). The light emitted from the right light source 352*a* is reflected toward the front (an example of a predetermined direction) by the right reflecting surface 342 of the reflector member 34. The reflected light passes through the translucent cover 32 and illuminates the front of the headlamp 30.

Similarly, when electric energy is supplied to the lower left light source 354*a* (an example of the third light source), the lower left light source 354*a* emits light toward the left lower (an example of a direction intersecting with the front and rear direction). The light emitted from the lower left light source 354*a* is reflected toward the front by the lower left reflecting surface 344 of the reflector member 34. The reflected light passes through the translucent cover 32 and illuminates the front of the headlamp 30.

Similarly, when electric energy is supplied to the lower right light source 356*a* (an example of the third light source), the lower right light source 356*a* emits light toward the right lower (an example of a direction intersecting with the front and rear direction). The light emitted from the lower right light source 356*a* is reflected toward the front upper by the lower right reflecting surface 346 of the reflector member 34. The reflected light passes through the translucent cover 32 and illuminates the front of the headlamp 30.

Figure 21:
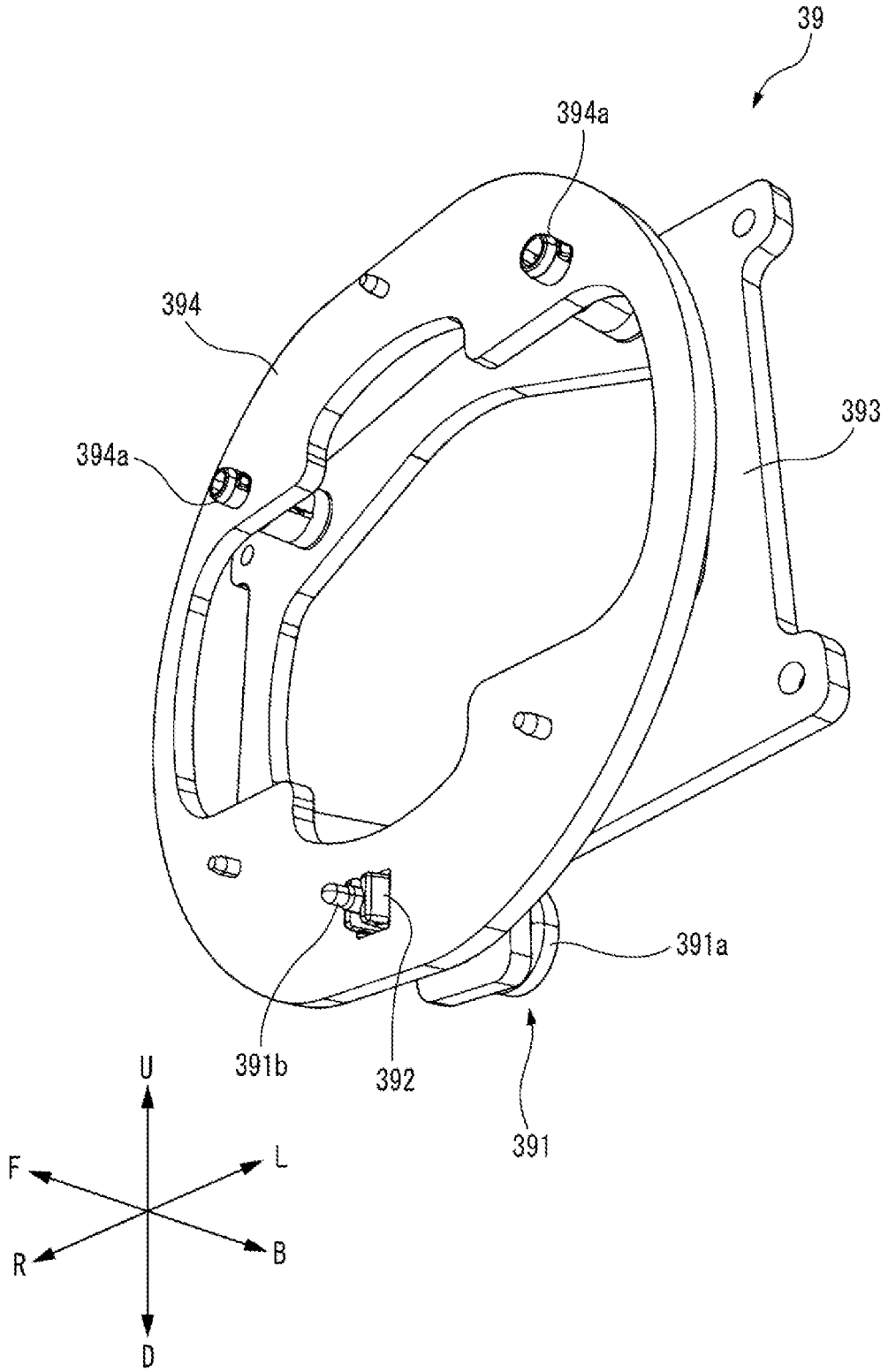
FIG. 21 is a perspective view showing an adjustment mechanism which can be provided in the headlamp in FIG. 11.

Due to errors in assembling a product or variations in mounting accuracy to vehicles, an error from a prescribed specification may occur on the posture of the reflector member 14 in some cases. In order to avoid a situation where a desired light distribution pattern cannot be obtained due to the error, the headlamp 30 can include an adjustment mechanism 39 shown in FIG. 21. The adjustment mechanism 39 includes a screw 391, a joint 392, a support plate 393, and a posture control plate 394.

The screw 391 has a screw head 391*a* and a screw shaft 391*b*. The screw 391 extends through a lower portion of the support plate 393. The screw head 391*a* can be rotatably operated by a predetermined tool. A screw groove is formed on an outer peripheral surface of the screw shaft 391*b*.

The joint 392 is provided in a lower portion of the posture control plate 394. The joint 392 has a through-hole. A screw groove (not shown) is formed on an inner peripheral surface of the through-hole. The screw shaft 391*b* extends in the through-hole of the joint 392. The screw groove formed on the outer peripheral surface of the screw shaft 391*b* is screwed into the screw groove formed in the through-hole of the joint 392.

The support plate 393 is fixed to a predetermined position in a vehicle. The posture control plate 394 is fixed to a rear portion of the reflector member 34. An upper portion of the posture control plate 394 is connected to the support plate 393 via a pair of connecting portions 394*a*. The pair of connecting portions 394*a* is configured by a universal joint or the like and can be displaced at least in the upper and lower direction.

When the screw head 391*a* is rotationally operated by a predetermined tool, the screw shaft 391*b* is rotated in the operation direction. The rotation of the screw shaft 391*b* is converted into the movement in the front and rear direction of the joint 392 via the screw grooves. In this way, the reflector member 34 can be tilted forward or backward from its original posture, so that it is possible to eliminate the errors from the prescribed specifications. Such adjustment of the posture of the reflector member 34 is performed before shipment of the headlamp 30 or during maintenance.

As described above, the headlamp 30 according to the present embodiment includes the reflector member 34, the left light source 351*a*, the right light source 352*a*, and the heat dissipation member 36. The heat dissipation member 36 has the wall portion 367 defining the hollow portion 368. The heat dissipation member 36 dissipates heat generated by the operations of the left light source 351*a* and the right light source 352*a*. The reflector member 34 is mounted to the heat dissipation member 36. The left light source 351*a* and the right light source 352*a* are disposed at positions facing the hollow portion 368 with the wall portion 367 interposed therebetween, respectively. The left light source 351*a* and the right light source 352*a* emit light in directions intersecting with the front and rear direction of the headlamp 30, respectively. The reflector member 34 is an integrally molded product, and has the left reflecting surface 341 and the right reflecting surface 342. The left reflecting surface 341 reflects light emitted from the left light source 351*a* in a predetermined direction. The right reflecting surface 342 reflects light emitted from the right light source 352*a* in a predetermined direction.

According to the above configuration, the light emitted from the left light source 351*a* is reflected by the left reflecting surface 341 of the reflector member 34, and the light emitted from the right light source 352*a* is reflected by the right reflecting surface 342 of the reflector member 34. Since the space spreading in a direction intersecting with the front and rear direction of the headlamp 30 having a relatively high degree of freedom of layout can be effectively utilized, it is easy to suppress an increase in the size in the front and rear direction, as compared to the configuration as disclosed in Patent Document in which the distribution of the light emitted forward from the light source is controlled by a lens part formed in the translucent cover.

Further, since the left light source 351*a* and the right light source 352*a* are disposed at positions facing the hollow portion 368 of the heat dissipation member 36 having a large surface area, the heat generated by the operations of the left light source 351*a* and the right light source 352*a* can be effectively dissipated. Therefore, the volume of the heat dissipation member 36 necessary for obtaining desired heat dissipation performance can be reduced, and an increase in the size of the headlamp 30 can be suppressed.

Furthermore, since the left reflecting surface 341 and the right reflecting surface 342 are parts of a single reflector member 34, the number of steps for mounting to the heat dissipation member 36 can be minimized.

In the present embodiment, the headlamp 30 includes the plurality of conducting wires 38 electrically connected to the left light source 351*a* and the right light source 352*a*. The plurality of conducting wires 38 extend in the hollow portion 368 of the heat dissipation member 36.

That is, the hollow portion 368 formed for improving the heat dissipation property is utilized as a space for arranging the plurality of conducting wires 38. In this way, the utilization efficiency of the space is improved and an increase in the size of the headlamp 30 can be suppressed.

The above description can be similarly applied to other light sources provided in the headlamp 30.

In the present embodiment, the translucent cover 32 is mounted to the reflector member 34.

According to such a configuration, the reflector member 34 can function as a housing defining the lamp chamber 33. A mechanism for adjusting the posture of the reflector member 34 may be provided outside the reflector member 34, as necessary. Therefore, it is possible to further suppress an increase in the size of the headlamp 30. Further, a watertight structure can be formed by the translucent cover 32, the reflector member 34, the first sealing member 371, and the second sealing member 372.

In the present embodiment, the left light source 351*a*, the right light source 352*a*, the upper left light source 353*a*, the lower left light source 354*a*, the upper right light source 355*a*, and the lower right light source 356*a* emit light in directions intersecting with the front and rear direction of the headlamp 30.

According to such a configuration, three or more light sources can be arranged with high space utilization efficiency. In this way, an increase in the size of the headlamp 30 can be suppressed.

The above embodiment is merely an example for facilitating the understanding of the disclosure. The configuration according to the above embodiment can be appropriately modified and improved without departing from the gist of the disclosure.

In the second embodiment, the single reflector member 34 mounted to the heat dissipation member 36 has the left reflecting surface 341, the right reflecting surface 342, the upper left reflecting surface 343, the lower left reflecting surface 344, the upper right reflecting surface 345, and the lower right reflecting surface 346. However, the reflector member 34 may be formed by integrating a plurality of subunits, and each subunit may have a plurality of reflecting surfaces which reflect light emitted from a plurality of light sources disposed at positions facing the hollow portion 368 with the wall portion 367 of the heat dissipation member 36 interposed therebetween.

In the second embodiment, the plurality of conducting wires 38 are electrically connected to the left light source 351*a*, the right light source 352*a*, the upper left light source 353*a*, the lower left light source 354*a*, the upper right light source 355*a*, and the lower right light source 356*a* via the left connector 351*c*, the right connector 352*c*, the upper left connector 353*c*, the lower left connector 354*c*, the upper right connector 355*c*, and the lower right connector 356*c*, respectively. However, the plurality of conducting wires 38 may be electrically connected to the respective light sources by soldering or the like to the contacts without connectors.

In the second embodiment, the left reflecting surface 341, the right reflecting surface 342, the upper left reflecting surface 343, the lower left reflecting surface 344, the upper right reflecting surface 345, and the lower right reflecting surface 346 of the reflector member 34 are configured so that all of the left light source 351*a*, the right light source 352*a*, the upper left light source 353*a*, the lower left light source 354*a*, the upper right light source 355*a*, and the lower right light source 356*a* illuminate the front. However, the area illuminated by each light source can be appropriately determined according to the specifications of the headlamp. For example, the left reflecting surface 341 and the right reflecting surface 342 of the reflector member 34 may be configured so that the left light source 351*a* and the right light source 352*a* illuminate different areas in front of the headlamp 30.

In the second embodiment, the headlamp 30 is exemplified as an example of the lighting device. However, the disclosure may be applied to various lighting devices which are configured to be mounted on a vehicle and include a plurality of light sources and a heat dissipation member. The front and rear direction, the left and right direction, and the upper and lower direction of the headlamp 30 are coincident with the front and rear direction, the left and right direction, and the upper and lower direction of the vehicle, respectively. However, depending on the lighting device to which the disclosure is applied, at least one of the front and rear direction, the left and right direction, and the upper and lower direction of the lighting device is not coincident with the front and rear direction, the left and right direction, and the upper and lower direction of the vehicle.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A lighting device mounted on a vehicle, the lighting device comprising:
- a first light source;
- a second light source;
- a heat dissipation member having a wall defining a hollow portion and configured to dissipate heat generated by operations of the first light source and the second light source; and
- a single reflector member mounted on the heat dissipation member,
- wherein the first light source and the second light source are disposed on the wall defining the hollow portion,
- wherein the first light source and the second light source are configured to emit light in directions away from the hollow portion and intersecting with a front and rear direction, and
- wherein the reflector member has
  - a first reflecting surface configured to reflect light emitted from the first light source in a predetermined direction, and
  - a second reflecting surface configured to reflect light emitted from the second light source in the predetermined direction.

2. The lighting device according to claim 1, further comprising:
- a first conducting wire electrically connected to the first light source; and
- a second conducting wire electrically connected to the second light source,
- wherein the first conducting wire and the second conducting wire are disposed behind the reflector member.

3. The lighting device according to claim 1, further comprising:
- a first conducting wire electrically connected to the first light source; and
- a second conducting wire electrically connected to the second light source,
- wherein the first conducting wire and the second conducting wire extend in the hollow portion.

4. The lighting device according to claim 3, further comprising:
- a translucent cover through which light emitted from the first light source and the second light source is transmitted,
- wherein the translucent cover is mounted to the reflector member.

5. The lighting device according to claim 1, further comprising;
- a third light source disposed on the wall defining the hollow portion,
- wherein the third light source is configured to emit light in a direction away from the hollow portion and intersecting with the front and rear direction.

6. The lighting device according to claim 1,
- wherein the first light source is configured to emit light for illuminating a first area, and
- wherein the second light source is configured to emit light for illuminating a second area different from the first area.

7. A lighting device mounted on a vehicle, the lighting device comprising:
- a first light source disposed on a wall defining a hollow portion;
- a first reflecting surface configured to reflect light emitted from the first light source in a predetermined direction;
- a first conducting wire electrically connected to the first light source in front of the first reflecting surface;
- a second light source disposed on the wall defining the hollow portion;
- a second reflecting surface configured to reflect light emitted from the second light source in the predetermined direction;
- a second conducting wire electrically connected to the second light source in front of the second reflecting surface; and
- an opaque cover covering the hollow portion, the first conducting wire and the second conducting wire at least from a front direction.

8. The lighting device according to claim 7, comprising;
- a first connector electrically connected to the first light source; and
- a second connector electrically connected to the second light source,
- wherein the first conducting wire is connected to the first connector from the front,
- wherein the second conducting wire is connected to the second connector from the front, and
- wherein the opaque cover covers the first connector and the second connector at least from the front direction.

9. The lighting device according to claim 7,
- wherein the first reflecting surface, the second reflecting surface, and the opaque cover are parts of a single reflector member.

* * * * *